US008821603B2

(12) United States Patent
Bitler et al.

(10) Patent No.: US 8,821,603 B2
(45) Date of Patent: Sep. 2, 2014

(54) HARD COMPACT AND METHOD FOR MAKING THE SAME

(75) Inventors: Jonathan W. Bitler, Fayetteville, AR (US); Sara Kiani, Fayetteville, AR (US)

(73) Assignee: Kennametal Inc., Latrobe, PA (US)

( * ) Notice: Subject to any disclaimer, the term of this patent is extended or adjusted under 35 U.S.C. 154(b) by 1405 days.

(21) Appl. No.: 11/715,608

(22) Filed: Mar. 8, 2007

(65) Prior Publication Data

US 2008/0230279 A1 Sep. 25, 2008

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |
| ***B24D 3/02*** | (2006.01) |
| ***C09C 1/68*** | (2006.01) |
| ***B22F 3/15*** | (2006.01) |
| ***C22C 26/00*** | (2006.01) |
| ***B22F 7/06*** | (2006.01) |
| *B22F 5/00* | (2006.01) |

(52) U.S. Cl.

CPC ..... *B22F 3/15* (2013.01); *C22C 2204/00* (2013.01); *C22C 26/00* (2013.01); *B22F 7/062* (2013.01); *B22F 2005/001* (2013.01)

USPC ..... 51/293; 51/307; 51/309

(58) Field of Classification Search

USPC ..... 51/293, 307, 309

See application file for complete search history.

(56) References Cited

U.S. PATENT DOCUMENTS

| | | | |
|---|---|---|---|
| 1,939,991 | A | 12/1933 | Krusell |
| 3,356,496 | A | 12/1967 | Hailey |
| 3,455,682 | A | 7/1969 | Barbaras |
| 3,469,976 | A | 9/1969 | Iler |
| 3,689,259 | A | 9/1972 | Hailey |
| 3,850,053 | A | 11/1974 | Bovenkerk |
| 4,148,368 | A | 4/1979 | Evans |
| 4,151,686 | A | 5/1979 | Lee et al. |
| 4,259,090 | A | 3/1981 | Bovenkerk |
| 4,341,557 | A | 7/1982 | Lizenby |

(Continued)

FOREIGN PATENT DOCUMENTS

| | | |
|---|---|---|
| WO | WO 95/16530 | 6/1995 |
| WO | WO 99/28589 | 6/1999 |
| WO | WO 00/34001 | 6/2000 |

OTHER PUBLICATIONS

Suryanarayana et al., "Novel Methods of Brazing Dissimilar Materials", Advanced Materials and Processes (Mar. 2001) (3 pages).

*Primary Examiner* — James McDonough

(74) *Attorney, Agent, or Firm* — Matthew W. Smith, Esq.

(57) ABSTRACT

A hard composite member produced by a rapid omni-directional compaction process that includes the steps of: providing a pre-compaction composite comprising a substrate, a superhard member and a layer of braze between the substrate and the superhard member; placing the pre-compaction composite in a pressure transmitting material contained within a shell to form an isostatic die assembly; heating the isostatic die assembly to a temperature at which the pressure-transmitting material is capable of fluidic flow and wherein the temperature ranges between greater than the melting point of the braze layer and less than or equal to about 1200° C.; and in a forging press, compressing the isostatic die assembly to consolidate the pre-compaction composite under omnidirectional pressure at a pressure equal to or greater than about 60,000 psi into a dense, consolidated body.

10 Claims, 13 Drawing Sheets

(56) References Cited

U.S. PATENT DOCUMENTS

| | | | | |
|---|---|---|---|---|
| 4,428,906 | A | 1/1984 | Rozmus | |
| 4,446,100 | A | 5/1984 | Adlerborn et al. | |
| 4,499,048 | A | 2/1985 | Hanelko | |
| 4,499,049 | A | 2/1985 | Hanejko | |
| 4,525,178 | A | 6/1985 | Hall | |
| 4,539,175 | A | 9/1985 | Lichti et al. | |
| 4,664,705 | A | 5/1987 | Horton et al. | |
| 4,670,025 | A | 6/1987 | Pipkin | |
| 4,673,549 | A | 6/1987 | Ecer | |
| 4,744,943 | A | 5/1988 | Timm | |
| 4,808,224 | A | 2/1989 | Anderson et al. | |
| 4,850,523 | A | 7/1989 | Slutz | |
| 4,875,907 | A | 10/1989 | Phaal et al. | |
| 4,915,605 | A | 4/1990 | Chan et al. | |
| 4,919,974 | A * | 4/1990 | McCune et al. | 427/249.7 |
| 4,923,512 | A | 5/1990 | Timm et al. | |
| 4,931,363 | A | 6/1990 | Slutz et al. | |
| 4,933,140 | A | 6/1990 | Oslin | |
| 4,940,180 | A | 7/1990 | Martell | |
| 4,945,073 | A | 7/1990 | Dubensky et al. | |
| 4,975,414 | A | 12/1990 | Meeks et al. | |
| 4,980,340 | A | 12/1990 | Anderson et al. | |
| 4,985,051 | A | 1/1991 | Ringwood | |
| 5,011,509 | A | 4/1991 | Frushour | |
| 5,032,352 | A | 7/1991 | Meeks et al. | |
| 5,127,923 | A | 7/1992 | Bunting et al. | |
| 5,159,857 | A | 11/1992 | Jurewicz | |
| 5,219,209 | A | 6/1993 | Prizzi et al. | |
| 5,232,522 | A | 8/1993 | Doktycz et al. | |
| 5,256,608 | A | 10/1993 | Dubensky et al. | |
| 5,334,561 | A | 8/1994 | Matsui et al. | |
| 5,429,199 | A | 7/1995 | Sheirer et al. | |
| 5,523,158 | A | 6/1996 | Kapoor et al. | |
| 5,563,107 | A | 10/1996 | Dubensky et al. | |
| 5,612,264 | A | 3/1997 | Nilsson et al. | |
| 5,662,183 | A | 9/1997 | Fang | |
| 5,716,170 | A | 2/1998 | Kammermeier et al. | |
| 5,804,321 | A | 9/1998 | Thorpe et al. | |
| 5,880,382 | A | 3/1999 | Fang et al. | |
| 6,102,140 | A | 8/2000 | Boyce et al. | |
| 6,234,261 | B1 | 5/2001 | Evans et al. | |
| 6,315,066 | B1 | 11/2001 | Dennis | |
| 6,372,012 | B1 * | 4/2002 | Majagi et al. | 75/236 |
| 6,460,636 | B1 | 10/2002 | Yong et al. | |
| 6,481,511 | B2 | 11/2002 | Matthias et al. | |
| 6,571,889 | B2 | 6/2003 | Griffo et al. | |
| 6,575,350 | B2 | 6/2003 | Evans et al. | |
| 6,592,985 | B2 | 7/2003 | Griffin et al. | |
| 6,607,249 | B2 | 8/2003 | Taitt | |
| 6,767,505 | B2 | 7/2004 | Witherspoon et al. | |
| 6,843,333 | B2 | 1/2005 | Richert et al. | |
| 6,945,340 | B2 | 9/2005 | Bise et al. | |
| 7,040,424 | B2 | 5/2006 | Yong et al. | |
| 7,128,773 | B2 | 10/2006 | Liang et al. | |
| 2005/0147520 | A1 | 7/2005 | Canzona | |
| 2005/0230150 | A1 | 10/2005 | Oldham et al. | |
| 2005/0230156 | A1 | 10/2005 | Belnap et al. | |
| 2005/0247491 | A1 | 11/2005 | Mirchandani et al. | |
| 2005/0263328 | A1 | 12/2005 | Middlemiss | |
| 2006/0060390 | A1 | 3/2006 | Eyre | |
| 2006/0060391 | A1 | 3/2006 | Eyre et al. | |
| 2006/0191723 | A1 | 8/2006 | Keshavan | |
| 2006/0207802 | A1 | 9/2006 | Zhang et al. | |
| 2006/0254830 | A1 * | 11/2006 | Radtke | 175/426 |
| 2007/0023206 | A1 | 2/2007 | Keshavan et al. | |
| 2008/0029310 | A1 * | 2/2008 | Stevens et al. | 175/374 |
| 2008/0223621 | A1 * | 9/2008 | Middlemiss et al. | 175/428 |

* cited by examiner

HARD COMPACT AND METHOD FOR MAKING THE SAME

BACKGROUND OF THE INVENTION

The present invention pertains to a compact, which is useful in a tool, that comprises a hard metal substrate that is bonded to a superhard member. The superhard member and the substrate are bonded together in such a fashion to from the compact so as to facilitate the attachment of the compact to the tool. Typical tools that utilize such hard compacts include earth boring (or engaging) bits (e.g., roof drill bits, conical style cutting bits (both underground mining and construction), and oil and natural gas drill bits (e.g., fixed cutter bits, roller cone bits and hammer bits).

The substrate of the hard compact typically comprises a cobalt cemented tungsten carbide wherein the cobalt content can range between about 3 weight percent and about 16 weight percent and wherein tungsten carbide (and recognized impurities) comprise the balance. The cobalt-tungsten carbide material may also include recognized additive such as titanium, tantalum, niobium and the like. Further, the substrate may comprise other metallic materials such as, for example and without limitation, steel, tool steel and refractory metals such as, for example and without limitation, titanium, niobium, molybdenum and their alloys.

The superhard member of the hard compact may comprise a thermally stable polycrystalline (TSP) diamond member wherein the cobalt has been either partially or fully (which is preferred) leached from the diamond structure. Although the basic method to make TSP is known to those skilled in the art, a brief description of the process for manufacturing TSP is set forth. A diamond table is a layer of randomly oriented individual diamond "crystals" that are bonded together at bonding lines known as diamond-diamond boundaries in the art. The bonding of individual diamond crystals in the diamond table forms a lattice structure. A metallic binder, typically cobalt, serves as a catalyst in the formation of bonds between individual diamond crystals, and is often found within the interstitial spaces in the diamond table's lattice structure. Cobalt has a significantly different coefficient of thermal expansion as compared to diamond, so upon heating of the diamond table, the cobalt will expand more rapidly than the diamond table, causing cracks to form in the lattice structure, and eventually resulting in deterioration of the diamond table.

In order to impede crack initiation and propagation in the diamond table resulting from differential thermal expansion, strong acids are used to "leach" the cobalt from the diamond lattice structure. The removal of cobalt from the diamond table results in thermal stability of the diamond table at higher temperatures but also increases its brittleness. Accordingly, in certain cases, only a select portion (measured in any dimension) of a diamond table is leached, in order to gain thermal stability without losing impact resistance. As used herein, the term TSP diamond member includes both of the above (i.e., partially and completely leached) materials.

The cobalt-leached TSP diamond member may be coated with nickel or tungsten metal or one or more of titanium metal and titanium carbide applied via physical vapor deposition (PVD) techniques. Representative patent documents that disclose this kind of coated TSP diamond include United States Application Publication No. US 2006/0254830 to Radtke for a THERMALLY STABLE DIAMOND BRAZING and U.S. Pat. No. 6,575,350 B2 to Evans et al.

The superhard member may also comprise a silicon carbide-bonded TSP diamond member or a silicon compound-bonded TSP diamond member. U.S. Patent Application Publication No. US2005/0230156 A1 to Belnap et al. discloses a method for the formation of a TSP diamond member using silicon or silicon carbide as a "getter" material in conjunction with cobalt-coated diamond particles. Representative patent documents that disclose a TSP diamond member that uses silicon include U.S. Pat. No. 4,151,686 to Lee et al. for a SILICON CARBIDE AND SILICON BONDED POLYCRYSTALLINE DIAMOND BODY AND METHOD OF MAKING IT, and U.S. Pat. No. 4,664,705 to Horton et al. for a THERMALLY STABLE POLYCRSYTALLINE DIAMOND, which mentions silicon infiltration of a diamond skeleton.

In addition, the superhard member may comprise any one of cubic boron nitride or silicon carbide or silicon nitride or alumina or SiAlON ceramics or conventional polycrystalline diamond.

In rotary well drilling operations, oil and natural gas bits are used to drill a bore hole in geological formations. These earth boring or engaging bits can include rotary cone bits, fixed cutter bits and hammer bits. In either type of earth boring bit, a steel body (or matrix) typically contains apertures that receive the hard compacts. These hard compacts (or inserts) are used as shearing, rock cutting, crushing, chipping or abrading elements. U.S. Pat. No. 5,159,857 to Jurewicz for a FIXED CUTTER BIT WITH IMPROVED DIAMOND FILLED COMPACTS, U.S. Pat. No. 5,662,183 to Fang for a HIGH STRENGTH MATRIX MATERIAL FOR PCD DRAG BITS, and United States Patent Application Publication US2005/0247491 A1 to Mirchandani et al. for EARTH-BORING BITS illustrate typical earth boring (or engaging) bits that use hard compacts. Each one of the above patent documents is hereby incorporated by reference herein.

U.S. Pat. No. 6,607,249 to Taitt for CONICAL BIT PENETRATOR POCKET PROTECTOR FOR EARTH DISPLACEMENT EQUIPMENT describes a typical conical style of cutting bit. Such a conical style of cutting bit has a hard member, which could be a hard compact, contained in a socket at the axial forward end thereof. U.S. Pat. No. 5,429,199 to Shierer et al. for CUTTING BIT AND CUTTING INSERT describes a typical roof drill bit. Such a roof drill bit has a hard member, which could be a hard compact, affixed to the axial forward end of the bit body. International Patent Application Publication No. WO 95/16530 to Kennametal Inc. for POLYCRYSTALLINE DIAMOND COMPOSITE CUTTING INSERT FOR ATTACHMENT TO A TOOL discloses a conical bit, as well as a roof drill bit, that includes a diamond composite hard member at the axial forward end thereof. Each one of the above patent documents is hereby incorporated by reference herein.

Hard compacts useful in the above-mentioned earth engaging bits have been made from cemented tungsten carbide. Cemented tungsten carbide typically comprises a metal binder (e.g., cobalt, nickel or iron) with the balance tungsten carbide particles. The most common binder metal is cobalt wherein the cobalt content ranges between about 3 weight percent and about 16 weight percent. Cemented tungsten carbide may also include other additives. The exact composition of the cemented tungsten carbide compact depends upon the desired properties for the specific drilling application. Exemplary compositions of cemented tungsten carbide suitable for use in earth engaging bits are set forth in the following patent documents: U.S. Pat. No. 5,219,209 to Prizzi et al. for a ROTATABLE CUTTING BIT INSERT (discloses cobalt cemented tungsten carbide inserts that comprise between about 5 to about 13 weight percent cobalt with the balance tungsten carbide, and wherein a specific composition comprised 5.4-6.0 weight percent cobalt with the balance tungsten carbide), and U.S. Pat. No. 6,945,340 to Bise et al. for a ROOF BIT AND INSERT ASSEMBLY (discloses tungsten carbide-cobalt alloys that comprise 5.4 weight percent cobalt with the balance tungsten carbide, 6.3 weight percent cobalt with the balance tungsten carbide, and 6.0 weight percent cobalt with the balance tungsten carbide).

In addition to cemented tungsten carbide compacts, it is typical that hard compacts have comprised sintered diamond on top of a cemented (cobalt) tungsten carbide substrate. In this regard, U.S. Pat. No. 1,939,991 to Krusell for a DIAMOND CUTTING TOOL OR THE LIKE AND METHOD OF MAKING THE SAME discloses a diamond cutting tool that has diamond inserts held in a cemented tungsten carbide matrix. As briefly described below, additional patent documents describe other hard compacts that comprise diamond and tungsten carbide.

In some prior art cutting tools, the diamond component of the tool was formed by the conversion of graphite to diamond. U.S. Pat. No. 3,850,053 to Bovenkerk for a CUTTING TOOL AND METHOD OF MAKING SAME describes a technique for making cutting tool blanks by placing a graphite disk in contact with a cemented tungsten carbide cylinder and exposing both simultaneously to diamond forming temperatures and pressures. U.S. Pat. No. 4,259,090 to Bovenkerk for a METHOD OF MAKING DIAMOND COMPACTS FOR ROCK DRILLING describes a technique for making a cylindrical mass of polycrystalline diamond by loading a mass of graphite into a cup-shaped container made from tungsten carbide and diamond catalyst material. The loaded assembly is then placed in a high temperature and pressure apparatus where the graphite is converted to diamond. U.S. Pat. No. 4,525,178 to Hall for a COMPOSITE POLYCRYSTALLINE DIAMOND shows a composite material which includes a mixture of individual diamond crystals and pieces of pre-cemented carbide. U.S. Pat. No. 4,148,368 to Evans for ROCK BIT WITH WEAR RESISTANT INSERTS shows a tungsten carbide insert for mounting in a rolling cone cutter which includes a diamond insert embedded in a portion of the work surface of the tungsten carbide cutting insert in order to improve the wear resistance thereof.

U.S. Pat. No. 5,159,857 describes a hard compact that has a hard metal substrate and a member of polycrystalline diamonds. To make the compact, diamond powder is placed in the inner volume of the metal substrate. This composite is subjected to a treatment under heat and pressure that sinters the diamond into a raw blank. The raw blank comprises a member of integrally formed polycrystalline diamond surrounded by the hard metal substrate. U.S. Patent Application Publication No. us2005/0230150 to Oldham et al. shows the use of coated diamond members in drill bit for an earth boring application. Other patent documents show the use of cutting inserts that employ diamonds wherein these patent documents include U.S. Pat. No. 6,234,261 B1 to Evans et al, U.S. Pat. No. 6,575,350 B2 to Evans et al. and PCT Patent Publication No. WO 99/28589 to Radtke.

Still other patent documents pertain to hard compacts for use in drill bits or components of hard compacts that use TSP diamond. In this regard, these patent documents include the following: U.S. Patent Application Publication No. US2006/0060391 to Eyre et al. for a THERMALLY STABLE DIAMOND POLYCRYSTALLINE DIAMOND CONSTRUCTION, U.S. Patent Application Publication No. US 2005/0263328 to Middlemiss for a THERMALLY STABLE DIAMOND BONDED MATERIALS AND COMPACTS, U.S. Patent Application Publication No. US 2006/0254830 to Radtke for THERMALLY STABLE DIAMOND BRAZING, U.S. Patent Application Publication No. US 2006/0191723 to Keshavan for THERMALLY STABLE POLYCRYSTALLINE DIAMOND MATERIALS, CUTTING ELEMENTS INCORPORATING THE SAME AND BITS INCORPORATING SUCH CUTTING ELEMENTS, and U.S. Patent Application Publication No. US 2006/0060390 to Eyre for THERMALLY STABLE DIAMOND POLYCRYSTALLINE DIAMOND CONSTRUCTIONS.

While the hard compacts that comprise a hard metal substrate bonded to a superhard (e.g., polycrystalline diamond) member have been used in tools such as earth boring or engaging bits, there remains a need to provide an improved hard compact that can be used in such tools. There also remains a need to provide such a compact that is of such a nature to facilitate the attachment of the hard compact to the tool.

Further, even though techniques used to braze TSP diamond to tungsten carbide exist (see Suryanarayana et al., "Novel Methods of Brazing Dissimilar Materials", *Advanced Materials & Processes* (March 2001) and U.S. Pat. No. 5,523,158 to Kapoor et al. for BRAZING OF DIAMOND FILM TO TUNGSTEN CARBIDE and PCT Patent Publication WO 00/34001 to Radtke for Microwave Brazing Process and Brazing Composition for TSP Diamond), there remains a need to be able to bond together a superhard member and a substrate that have heretofore been difficult to satisfactorily bond together to form a hard compact. There also remains a need to be able to bond together a superhard member and a substrate that have heretofore been difficult to satisfactorily bond together to form a hard compact that is of such a nature to facilitate the attachment of the hard compact to the tool.

SUMMARY OF THE INVENTION

In one form thereof, the invention is a hard composite member produced by a rapid omni-directional compaction process comprising the steps of: providing a pre-compaction composite comprising a substrate, a superhard member and a layer of braze between the substrate and the superhard member; placing the pre-compaction composite in a pressure transmitting material contained within a shell to form an isostatic die assembly; heating the isostatic die assembly to a temperature at which the pressure-transmitting material is capable of fluidic flow and wherein the temperature ranges between greater than the melting point of the braze layer and less than or equal to about 1200° C.; and in a forging press, compressing the isostatic die assembly to consolidate the pre-compaction composite under omnidirectional pressure equal to or greater than about 60,000 psi into a dense, consolidated body.

In yet another form thereof, the invention is a hard composite member produced by a rapid omni-directional compaction process comprising the steps of: providing a pre-compaction composite comprising a substrate comprising a partially dense green body and a superhard member; placing the pre-compaction composite in a pressure transmitting material contained within a shell to form an isostatic die assembly; heating the isostatic die assembly to a temperature at which the pressure-transmitting material is capable of fluidic flow; and in a forging press, compressing the isostatic die assembly to consolidate the pre-compaction composite under omnidirectional pressure equal to or greater than about 60,000 psi into a dense, consolidated body.

In still another form thereof, the invention is a rapid omni-directional compaction process for producing a hard composite body comprising the steps of: providing a pre-compaction composite comprising a substrate, a superhard member and a layer of braze between the substrate and the superhard member; placing the pre-compaction composite in a pressure transmitting material contained within a shell to form an isostatic die assembly; heating the isostatic die assembly to a temperature at which the pressure-transmitting material is capable of fluidic flow and wherein the temperature ranges between greater than the melting point of the braze layer and less than or equal to about 1200° C.; and in a forging press, compressing the isostatic die assembly to consolidate the pre-compaction composite under omnidirectional pressure equal to or greater than about 60,000 psi into a dense, consolidated body.

In yet another form thereof, the invention is a rapid omni-directional compaction process for producing a hard composite body comprising the steps of: providing a pre-compaction composite comprising a substrate comprising a partially dense green body and a superhard member; placing the pre-compaction composite in a pressure transmitting material contained within a shell to form an isostatic die assembly; heating the isostatic die assembly to a temperature at which the pressure-transmitting material is capable of fluidic flow; and in a forging press, compressing the isostatic die assembly to consolidate the pre-compaction composite under omnidirectional pressure equal to or greater than about 60,000 psi into a dense, consolidated body.

In still another form thereof, the invention is a consolidation process for producing a hard composite body comprising the steps of: providing a pre-compaction composite comprising a substrate comprising a partially dense green body and a superhard member; placing the pre-compaction composite in a bed of flowable particles; and effecting pressurization of said bed to cause pressure transmission via said particles to said pre-compaction composite, thereby to consolidate the pre-compaction composite into the hard composite.

BRIEF DESCRIPTION OF THE DRAWINGS

The following is a brief description of the drawings that form a part of this patent application.

DETAILED DESCRIPTION

Figure 1:
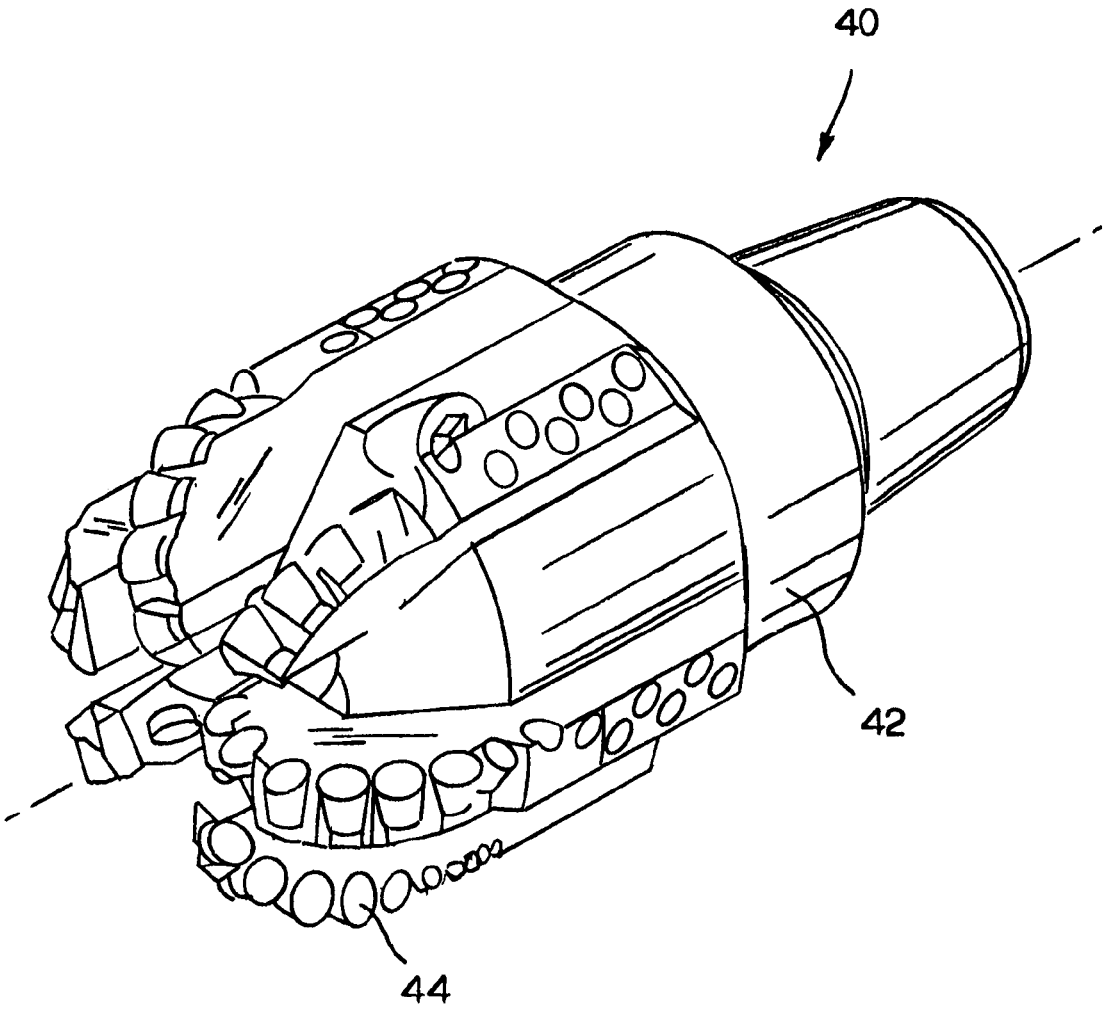
FIG. 1 is an isometric view of a rotary drill bit that uses the hard compacts of the invention.

Referring to the drawings, there is shown in FIG. 1 a rotary drill bit generally designated as 40. Rotary drill bit 40 has a body 42 that carries a plurality of hard compacts 44 that are shown and described in this patent application and made according to the method shown and described in this patent application. The geometry of the rotary drill bit 40 is along the same lines as the fixed cutter bit shown in U.S. Pat. No. 6,481,511 B2 to Matthias et al. for a ROTARY DRILL BIT.

Figure 3:
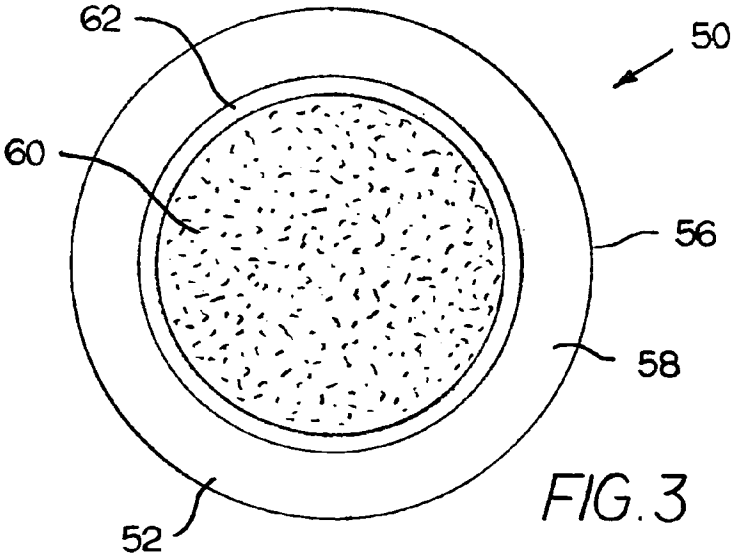
FIG. 3 is a top view of the hard compact of FIG. 2.
Figure 2:
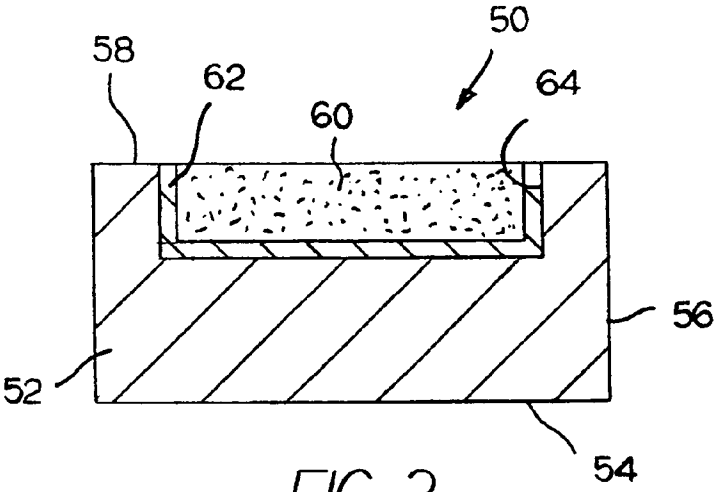
FIG. 2 is a cross-sectional side view of one specific embodiment of a hard compact with a cylindrical substrate that contains a cylindrical cavity containing a superhard member and wherein a layer of braze is between the superhard member and the substrate.

FIGS. 2 and 3 show one specific embodiment of a hard compact 50 of the invention. Hard compact 50 includes a hard metal substrate 52 that presents a generally cylindrical shape. Hard metal substrate 52 has a generally circular bottom surface 54, a peripheral circumferential surface 56 and a generally circular top surface 58. Substrate 52 contains a cylindrical cavity 64 in the top surface 58 thereof. In this embodiment, the cavity 64 is substantially in the geometric center of the top surface 58 of the substrate 52. The hard compact 50 further has a superhard member (or insert) 60 that has a generally cylindrical shape. There is a layer of braze material 62 between the superhard member 60 and the surfaces that define the cavity 64 so that the superhard member 60 is affixed to the substrate 52 via brazing at the areas of contact.

Figure 5:
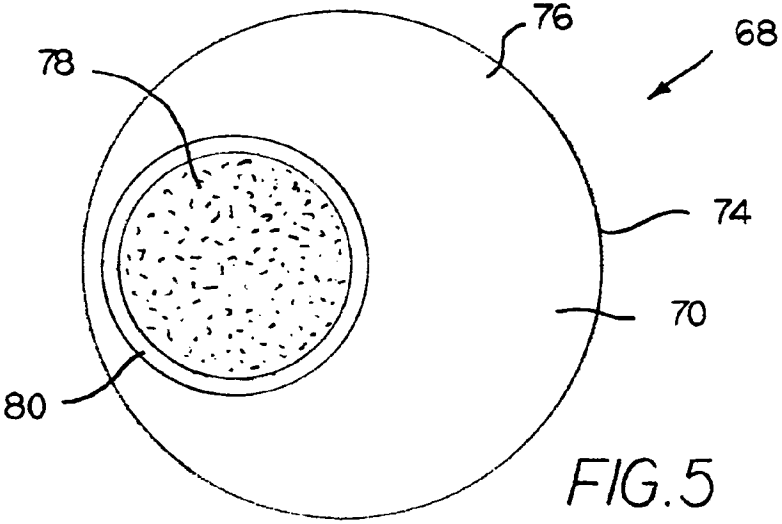
FIG. 5 is a top view of the hard compact of FIG. 4.
Figure 4:
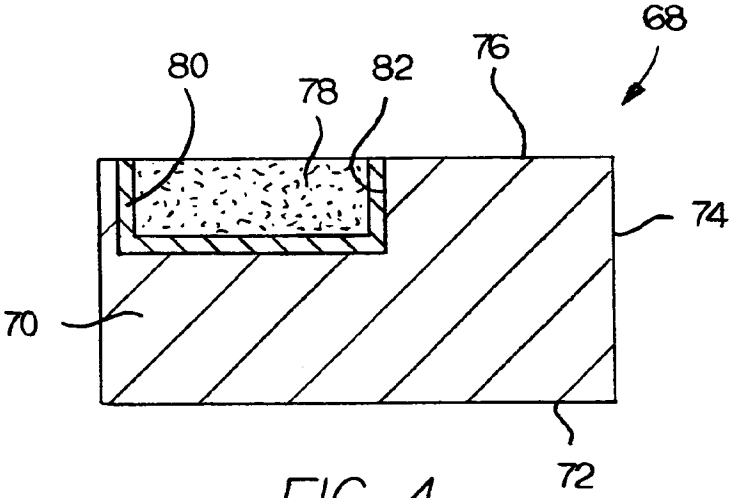
FIG. 4 is a cross-sectional side view of another specific embodiment of a hard compact with a cylindrical substrate that contains a cylindrical cavity that is offset from the geometric center of the top face of the compact and containing a superhard member wherein a layer of braze is between the superhard member and the substrate.

FIGS. 4 and 5 show another specific embodiment of a hard compact 68 of the invention. Hard compact 68 includes a hard metal substrate 70 that presents a generally cylindrical shape. Hard metal substrate 70 has a generally circular bottom surface 72, a peripheral circumferential surface 74 and a generally circular top surface 76. Substrate 70 contains a generally cylindrical cavity 82 in the top surface 76 thereof. In this embodiment, the cavity 82 is offset from the geometric center of the top surface 76 of the substrate 70. The hard compact 68 further has a superhard member (or insert) 78 that has a generally cylindrical shape. There is a layer of braze material 80 between the superhard member 78 and the surfaces that define the cavity 82 so that the superhard member 78 is affixed to the substrate 70 via brazing at the areas of contact.

Figure 6:
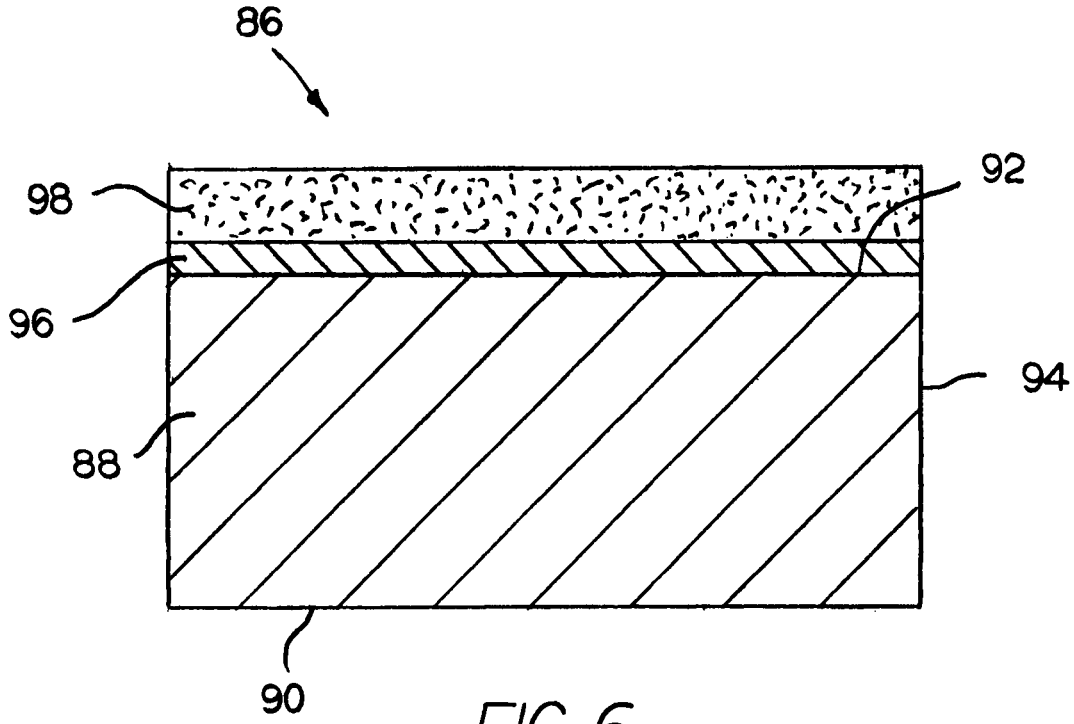
FIG. 6 is a cross-sectional side view of still another specific embodiment of a hard compact with a cylindrical substrate wherein a layer of braze is on the top face of the substrate and the superhard member is on the layer of braze.

FIG. 6 illustrates still another specific embodiment of a hard compact of the invention 86. Hard compact 86 comprises a substrate 88 that has a generally cylindrical geometry. Substrate 88 has a bottom surface 90 and a top surface 92 wherein a peripheral surface 94 join together the top surface 92 and the bottom surface 90. A layer of braze alloy 96 is on the top surface 92. A superhard member 98 is on the layer of braze alloy 96.

Figure 7:
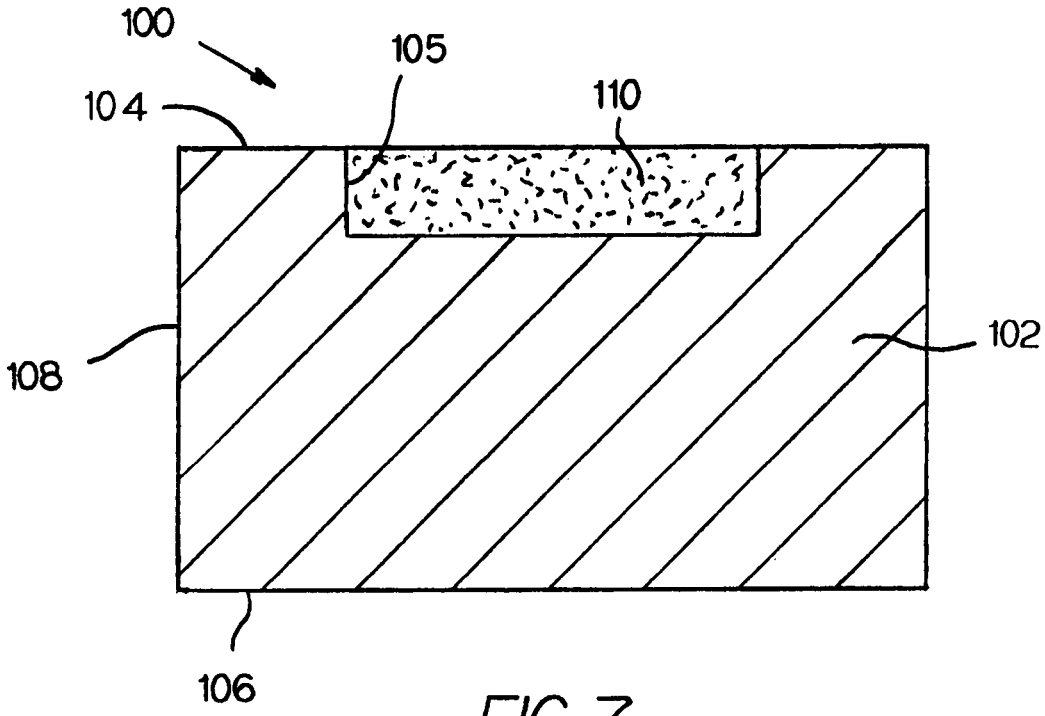
FIG. 7 is a cross-sectional side view of still another specific embodiment of a hard compact with a cylindrical substrate wherein the superhard member is within a cavity contained in the top face of the substrate without any layer of braze alloy.

FIG. 7 illustrates still another specific embodiment of the hard compact of the invention 100. Hard compact 100 comprises a substrate 102 that has a generally cylindrical geometry. Substrate 102 has a bottom surface 106 and a top surface 104 wherein a peripheral surface 108 joins together the top surface 104 and the bottom surface 106. The substrate 102 defines a cavity 105 that opens at the top face 104 thereof. There is an absence from this embodiment of a layer of braze alloy. A superhard member 110 is contained within the cavity 105.

It should be appreciated that the pre-compaction condition of the substrate 102 was that it was a so-called green compact, which means that it exhibited a partial density. During the ROC process, the substrate 102 was securely joined or bonded to the superhard member 110. Further, upon the pre-compaction composite being subjected to the ROC process, the shrinkage of the green substrate would essentially mechanically lock the superhard member in the cavity. In such an arrangement, the superhard member could be bonded to the substrate via a metallurgical phenomenon, as well as through the mechanical bonding or locking mechanism.

As still another alternative, the pre-compaction composite that uses the green substrate could also employ a layer of braze alloy between the green substrate and the superhard member. In this arrangement, after compaction by the ROC process, the superhard member would be both mechanically bonded or locked to the substrate, as well as metallurgically bonded to the substrate at the braze joint.

Figure 8:
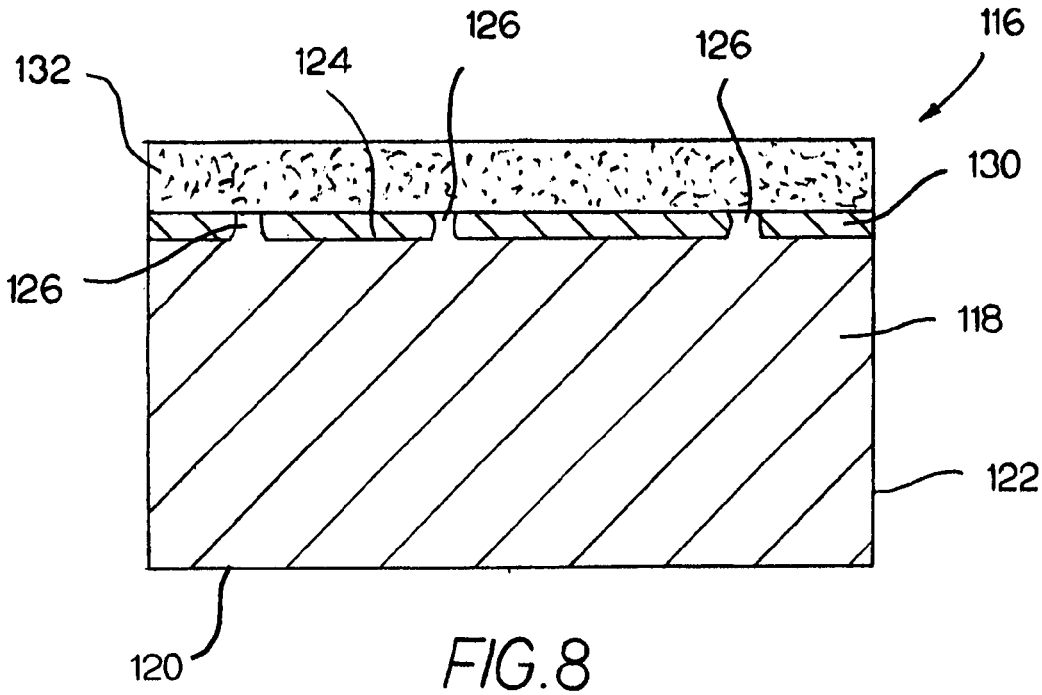
FIG. 8 is a cross-sectional side view of yet another specific embodiment of a hard compact with a cylindrical substrate that has a top face with dimples extending away therefrom and wherein a layer of braze is on the top face of the substrate and the superhard member is on the layer of braze.
Figure 8A:
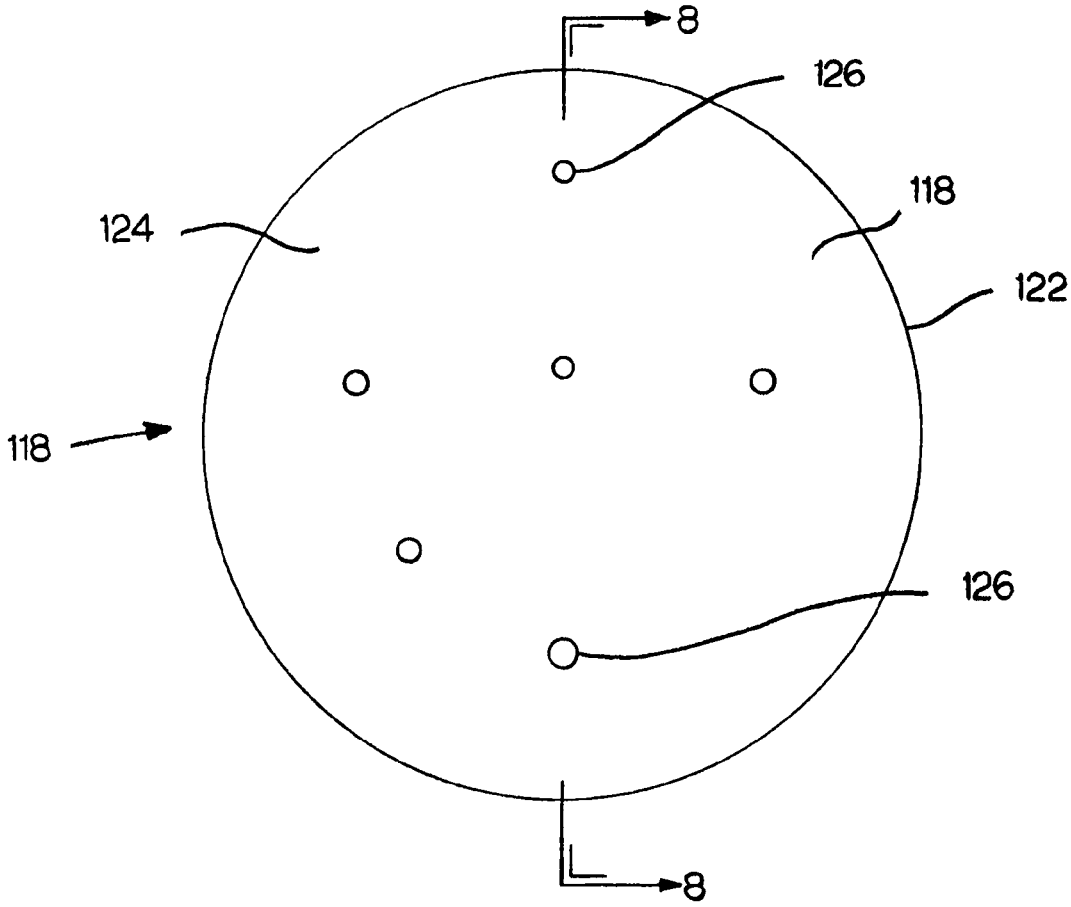
FIG. 8A is a top view of the substrate of the hard compact of FIG. 8 showing the dimples.

FIGS. 8 and 8A illustrate still another specific embodiment of the hard compact of the invention 116. Hard compact 116 comprises a substrate 118 that has a generally cylindrical geometry. Substrate 118 has a bottom surface 120 and a peripheral surface 122, which joins together the bottom surface 120 and a top surface 124. The top surface 124 contains a plurality of dimples (or spacers) 126 that project away from the top surface 124. These dimples 126 function as spacers between the top surface 124 of the substrate 118 and the bottom surface of the superhard member 132 so as to provide for a braze layer 130 that is of a generally uniform thickness across the braze joint. It should be appreciated that the dimples can take any number of sizes and shapes to enhance the integrity of the bond between the substrate and the superhard member.

The specific embodiments illustrated in FIGS. 2 and 3, 4 and 5, FIG. 6 and FIG. 8 each present the layer of braze as a distinct layer with no extrusion into the superhard member or the substrate. In each of these embodiments, braze material bonds with the superhard member and with the substrate. However, as shown in the photomicrographs, bonding can occur in more than one way.

A cobalt-leached TSP diamond member exhibits porosity (as defined by voids) due to the removal of the cobalt or other binder material. In the case where the superhard member (or possibly the substrate) has porosity, braze material extrudes into the voids that define the porosity during the ROC (or other consolidation) process. In such a situation, braze material bonds to the superhard member with porosity via extrusion of braze into the voids that define the porosity. Other kinds of superhard members, as well as substrates in the typical case, do not exhibit porosity defined by voids. Braze material bonds to those superhard members (or substrates) that do not have porosity by a surface wetting phenomenon. In the cases where braze material is used, applicants thus consider bonding between braze material and the superhard member (or substrate) to occur when there is extrusion of braze into the voids that define the porosity in the superhard member (or substrate) and/or there is a surface wetting phenomenon between the braze layer and superhard member (or substrate). It should be appreciated that typically when there is extrusion of braze into the voids that define the porosity, there also exists the surface wetting phenomenon.

Further, applicants also consider bonding to occur between the substrate and the superhard member in those situations where the substrate has shrunk around all or part of the superhard member. As described herein, in such a situation, the green (partially dense) substrate contains a cavity that receives the superhard member. Upon completion of the consolidation process, the green substrate has shrunk in volume so as to compress against the superhard member. The existence of the mechanical bonding (or locking) between the substrate and the superhard member can exist whether or not there is also braze material present.

Referring to each one of the above specific embodiments, one preferred material for the substrate is cobalt cemented tungsten carbide wherein the cobalt content can range between about 3 weight percent and about 16 weight percent wherein tungsten carbide (and recognized impurities) comprising the balance. The cobalt-tungsten carbide material may also include recognized additive such as titanium, tantalum, niobium and the like. Applicants also contemplate that the substrate may comprise other metallic materials such as, for example and without limitation, steel, tool steel and refractory metals such as, for example and without limitation, titanium, niobium, molybdenum and their alloys.

Also referring to each one of the above embodiments, the superhard member may comprise any one of a number of different TSP diamond members. In this regard, the superhard member may comprise a cobalt-leached TSP diamond material. As mentioned hereinabove, representative patent documents that disclose cobalt-leached TSP diamond material includes U.S. Pat. No. 4,931,363 to Slutz et al. for BRAZED THERMALLY-STABLE POLYCRYSTALLINE DIAMOND COMPACT WORKPIECES, U.S. Pat. No. 6,592,985 to Griffin et al. for a POLYCRYSTALLINE DIAMOND PARTIALLY DEPLETED OF CATALYZING MATERIAL, and U.S. Pat. No. 5,127,923 to Bunting et al. for a COMPOSITE ABRASIVE COMPACT HAVING HIGH THERMAL STABILITY.

The superhard member may also comprise a silicon carbide-bonded TSP diamond member or a silicon compound-bonded TSP diamond member. U.S. Patent Application Publication No. US2005/0230156 A1 to Belnap et al. discloses a method for the formation of a TSP diamond member using silicon or silicon carbide as a "getter" material in conjunction with cobalt-coated diamond particles. Representative patent documents that disclose a TSP diamond member that uses silicon include U.S. Pat. No. 4,151,686 to Lee et al. for a SILICON CARBIDE AND SILICON BONDED POLYCRYSTALLINE DIAMOND BODY AND METHOD OF MAKING IT, and U.S. Pat. No. 4,664,705 to Horton et al. for a THERMALLY STABLE POLYCRSYTALLINE DIAMOND, which mentions silicon infiltration of a diamond skeleton.

The superhard member may comprise a nickel-coated TSP diamond material. Representative patent documents that disclose this kind of TSP diamond include United States Application Publication No. US 2006/0254830 to Radtke for a THERMALLY STABLE DIAMOND BRAZING and U.S. Pat. No. 6,575,350 B2 to Evans et al.

These kinds of TSP diamond materials (e.g., cobalt-leached TSP diamond material, silicon carbide-bonded TSP diamond material, silicon compound-bonded TSP diamond material, cobalt-leached nickel-coated TSP diamond material) are typically stable up to a temperature equal to about 1200° C. It should also be appreciated that the superhard member may comprise cubic boron nitride (cBN), as well as other recognized superhard materials (for example, without limitation, coated TSP diamond wherein the coating comprises one or more of tungsten metal and titanium metal and titanium carbide applied via physical vapor deposition (PVD) techniques, silicon carbide, silicon nitride, alumina, SiAlON ceramics and conventional polycrystalline diamonds).

In regard to the braze alloy, it may take on the form of a paste (or powder) or a strip wherein the strip has a minimum thickness equal to about 0.003 inches (about 0.08 millimeters). In the case of a braze strip, it is also possible to coat the braze strip with a metal such as, for example, titanium.

It is preferable that the braze alloy is an active braze alloy that has a melting point equal to or greater than about 800° C. and may include (without limitation) any one or more of the following elements: silver, copper, nickel, titanium, vanadium, niobium, phosphorous, gold, palladium, chromium, silicon, aluminum, indium, and molybdenum. It is contemplated that instead of a single layer of braze alloy, the interface between the substrate and the superhard member (e.g., TSP diamond body) may comprise a braze scheme which comprise two layers of braze alloy. One of the braze alloy layers wets the superhard member (e.g., TSP diamond body) and the other bonds the diamond-wetting braze to the material that forms the substrate (e.g., cemented (cobalt) tungsten carbide). Further, it is contemplated that the superhard member (e.g., TSP diamond body) may be coated with a braze alloy to provide either the only braze alloy or a part of the overall braze alloy scheme.

The general geometry of the above embodiments is generally cylindrical; however, it should be appreciated that the geometric shapes of the hard compacts could be other than cylindrical. For example, the shape of the hard compact could be an elongate oval shape in cross section or square in cross-section or rectangular in cross-section. The specific application for the hard compact may dictate (or at least influence) the geometry thereof keeping in mind that during the drilling operation, the superhard member impinges upon the earth strata of the geological formation to shear, cut, crush, chip or abrade the components (e.g., rock) of the earth strata.

Figure 9:
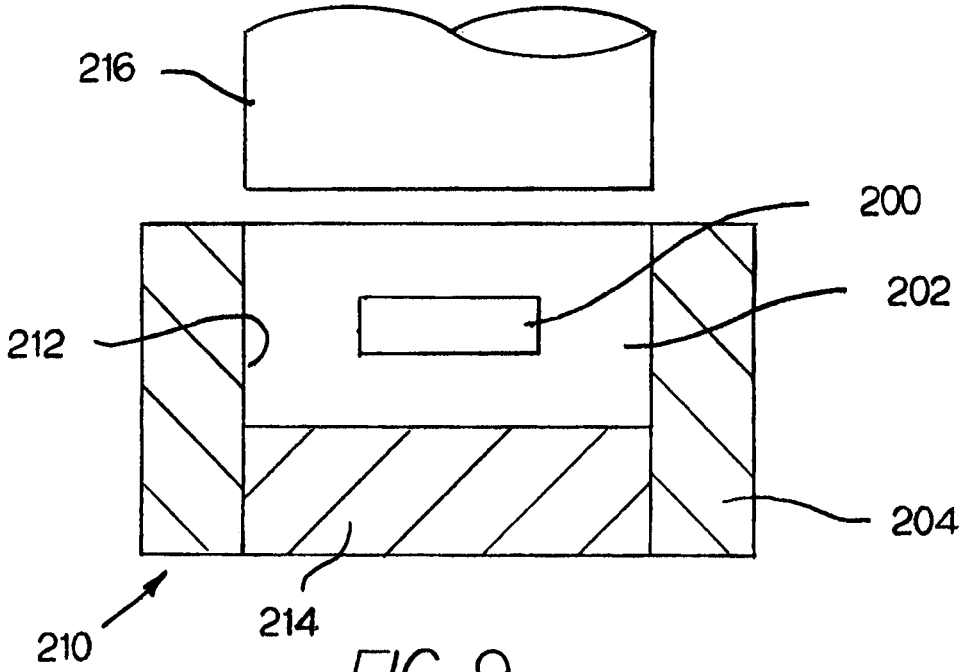
FIG. 9 is a mechanical schematic view of the ram and the die of the rapid omni-directional compaction process prior to the compaction of the pre-compaction composite that forms the hard compact.
Figure 10:
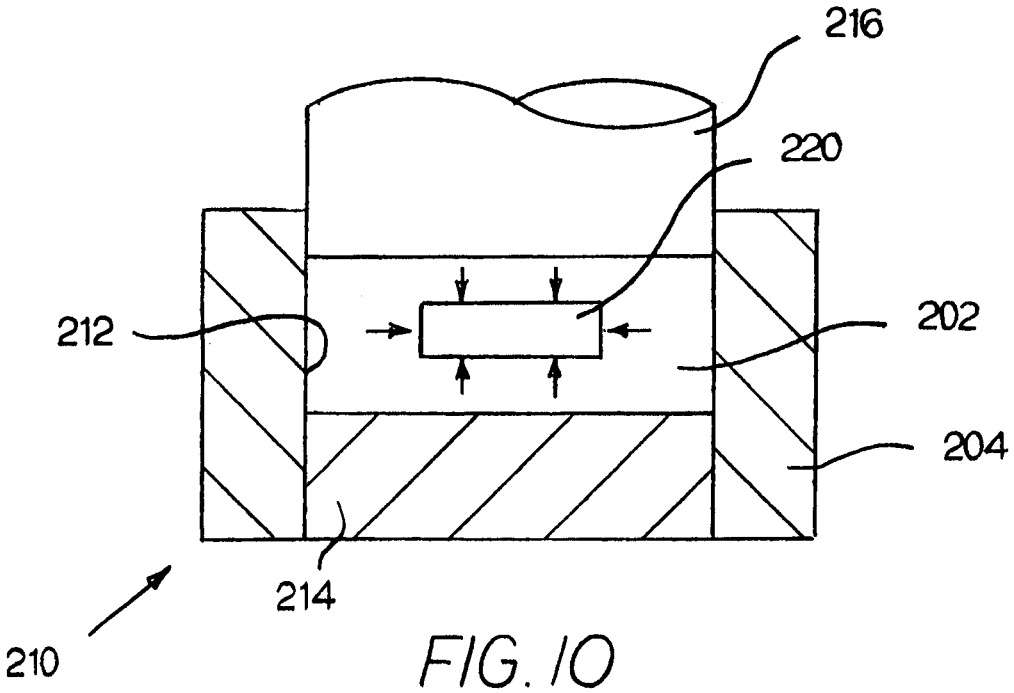
FIG. 10 is a mechanical schematic view of the ram and the die of the rapid omni-directional compaction process after completion of the ROC process that forms the hard insert.

The inventive method to make the hard compact uses the rapid omni-directional compaction (ROC) process. Referring to FIGS. 9 and 10, in the ROC process, a pre-compaction composite body (or multiple pre-compaction bodies) 200 is first embedded in a pressure transmitting material 202 that acts like a viscous liquid at the compaction temperature. The pressure transmitting material 202 and the pre-compaction composite body 200 are contained in a shell 204.

Suitable pressure transmitting materials include glasses that have sufficient viscosity so that the glass fails to penetrate the body under an applied pressure. Representative glasses include glasses containing high concentrations of silica and boron. A commercial glass useful in the temperature range from 1000° C. to 1400° C. is Corning-type PYREX 7740™ glass. Pressure transmitting materials are described in more detail in the following patent documents: U.S. Pat. No. 4,446,100; U.S. Pat. No. 3,469,976; U.S. Pat. No. 3,455,682; and U.S. Pat. No. 4,744,943. Each one of the above-mentioned patent documents is incorporated herein by reference in their entirety. Another suitable pressure transmitting material is soda lime glass. In this regard, based upon a data sheet from Flex-O-Lite, Inc., a general composition (in weight percent) for soda lime glass is 73% silicon dioxide, 15% sodium dioxide, 7% calcium oxide, 4% magnesium oxide and 1% alumina (aluminum oxide).

The shell containing the pre-compaction composite body and pressure transmitting medium preferably forms an enclosed right cylinder that can be placed in pot die tooling 210 of a forging press. The pot die tooling 210, as it is known in the forging industry, consists of a cylindrical cavity 212 closed at one end by an ejector assembly 214 and at the other by a cylindrical ram 216. Upon compression in the tooling, the shell must distort predictably and not crack or leak.

The preferred shell material for the temperature range from 150° C. to about 1650° C. using glass pressure transmitting media is a shell cast of a thixotropic ceramic, as described by U.S. Pat. No. 4,428,906 to Timm, incorporated herein by reference. The thixotropic ceramic material comprises a ceramic skeleton network and pressure transmitting material that deforms or fractures allowing compression of the pressure transmitting material, while retaining enough structural integrity to keep the pressure transmitting fluid from leaking out of the pot die.

Once the pre-compaction composite body 200 is embedded in the pressure transmitting material contained in the shell, this shell assembly is heated in an inert atmosphere to a temperature suitable for forging. The temperature of this step ranges between about 700° C. and about 1200° C. with a preferred temperature equal to less than or equal to about 1100° C. It should be appreciated that it is typical the specific temperature is dependent upon the overall material system. These considerations include the braze alloy system, the specific composition and properties of the substrate and the TSP diamond, and the condition of the substrate (e.g., a partially dense green body or a fully dense sintered body).

The time at temperature must be a time sufficient to completely fluidize the pressure-transmitting medium and to bring the bodies to a temperature roughly in equilibrium with the temperature of the pressure transmitting material. Typical times range from between about 1 hour to about 3 hours for both heating to the compaction temperature and maintaining the compaction temperature. The time at the compaction temperature is maintained generally from about 1 to about 30 minutes before being pressed in the pot die of the forging pressed described below.

The heated shell assembly is pressed in a forging press as described below and by U.S. Pat. No. 4,744,943 to Timm, incorporated herein by reference. The heated shell is pressed in the forging press by compressing the assembly with a ram in a closed cavity such as the pot die tooling previously described. As the ram compresses the assembly in the cavity, the pressure transmitting material exerts a large hydrostatic pressure (for example, and without limitation, 120,000 psi) on the bodies to densify them. The shell material of the assembly flows into the clearance between the ram and pot die and forms, in effect, a pressure seal so that the liquid pressure transmitting material does not escape into the pot die.

After pressing, the shell assembly is ejected from the pot die.

After ejection from the pot die, the densified bodies are separated from the pressure transmitting material (PTM) by a method such as pouring the liquid PTM through a screen, the densified bodies being retained on the screen which is described in greater detail in U.S. Pat. No. 4,744,943 to Timm, which is incorporated herein by reference. Any residual material remaining on the bodies may be removed by, for example, sand blasting. The entire assembly may also be cooled to room temperature before removing the densified bodies. The bodies are subsequently removed from the hardened glass PTM, for example, by breaking the glass PTM with a hammer. Further finishing of the densified bodies such as grinding and polishing may be performed.

Various aspects of the ROC process are disclosed in the following documents: U.S. Pat. No. 4,744,943 to Timm, U.S. Pat. No. 4,656,002 to Lizenby, U.S. Pat. No. 4,341,557 to Lizenby, U.S. Pat. No. 4,428,906 to Rozmus, and an article by Kelto (Metals Handbook, "Rapid Omnidirectional Compaction" Vol. 7, pages 542-546). Various aspects of using a bed of pressure transmitting material are treated in Meeks et al. (U.S. Pat. Nos. 5,032,352 and 4,975,414); Anderson et al. (U.S. Pat. Nos. 4,980,340 and 4,808,224); Oslin (U.S. Pat. No. 4,933,140); and Chan et al. (U.S. Pat. No. 4,915,605). Each one of the above patents is hereby incorporated by reference herein.

Applicants contemplate that the compaction process may also include those compaction processes shown and described in one or more of the following United States patent documents. One such patent document is U.S. Pat. No. 6,767,505 B2 to Witherspoon et al. which describes a consolidation process by which combustible gases are ignited to create the pressure to drive pistons and movable dies to consolidate an article.

Another such patent document is United States Patent Application Publication US2005/0147520 to Canzona. The Canzona patent document describes a so-called Ceracon process in which a powder is placed within and surrounded by a bed of flowable pressure transmitting medium (PTM) whereby the PTM is pressurized and compressed so that pressure is transmitted through the PTM to the powder. The Canzona patent document discloses pre-heating the PTM prior to the consolidation process.

In still another patent document, U.S. Pat. No. 4,673,549 to Ecer discloses a process by which first and second powder components are consolidated through longitudinally applied pressure. The Ecer patent also discloses that the Ceracon process is disclosed in the following U.S. patents: U.S. Pat. No. 3,356,496 to Hailey, U.S. Pat. No. 3,689,259 to Hailey, U.S. Pat. No. 4,499,048 to Hanejko, U.S. Pat. No. 4,499,049 to Hanejko and U.S. Pat. No. 4,539,175 to Lichti et al.

In circumstances that utilize a green (i.e., a partially dense) substrate, it is expected that the pre-compaction composite may exhibit a shrinkage factor equal to between about 1.18 and about 1.24. As an alternative, the shrinkage factor equal to between about 1.19 and about 1.24. One specific shrinkage factor is equal to about 1.22. The shrinkage is due to the consolidation of the green substrate upon being subjected to the consolidation process (e.g., the ROC process). In those situations where the green substrate contains a cavity or the like that receives the superhard member, the shrinkage of the green substrate results in a mechanical bonding between the substrate and the superhard member.

The present invention is illustrated by the following Examples 1 through 28 of Table 1, which are provided to demonstrate the various aspects of the present invention. The following examples should not be construed as limiting the scope of the claimed invention.

The following inventive Examples 1 through 28 demonstrate the advantages connected with the hard compact of the present invention. For each one of the inventive examples, the substrate (or substrate) was cobalt cemented tungsten carbide sold by Kennametal Inc. of Latrobe, Pa. 15650 under the designated RTW 374. This grade RTW 374 has a composition of about 6 weight percent cobalt with the balance tungsten carbide and recognized impurities. Another acceptable grade for the substrate is a cobalt cemented tungsten carbide sold by Kennametal Inc. of Latrobe, Pa. 15650 under the designated RTW 393, which has a composition of about 9 weight percent cobalt with the balance tungsten carbide and recognized impurities. Further, applicants contemplate that the cemented (cobalt) tungsten carbide may have a composition that ranges between about 3 weight percent and about 16 weight percent cobalt with the balance tungsten carbide and recognized impurities. Applicants contemplate that the cemented (cobalt) tungsten carbide could also contain recognized additives such as those mentioned hereinabove and those known to those skilled in the art.

For Examples 1 through 28, Table 1 below sets forth the composition (in weight percent) and form (i.e., the braze was either in the form of a strip that was 0.003 inches (0.08 millimeters) thick or in the form of a paste), as well as the liquidus temperature (in ° C.), of the specific braze alloy. Further, Table 1 sets forth the supplier of the braze alloy and the supplier's designation for the braze alloy. In this regard, the designation "Prince & Izant" refers to The Prince & Izant Company, 12999 Plaza Drive, Cleveland, Ohio 44130. The designation "Fusion" refers to Fusion Inc., 4658 East 355$^{th}$ Street, Willoughby, Ohio 44094. The designation "Lucas-Milhaupt" refers to Lucas Milhupt, Inc., 5656 S. Pennsylvania Ave., Cudahy, Wis. 53110. The designation "Morgan Advanced Ceramics" refers to Morgan Technical Ceramics, 26 Madison Road, Fairfield, N.J. 07004. Although not specifically listed in Table 1, applicants contemplate that another suitable braze alloy is designated as Gold-ABA and has the composition: about 97.5 weight percent gold, about 0.75 weight percent nickel, and about 1.75 weight percent vanadium.

In reference to Examples 17-19, the designation "+Nb" and "+Cr" means small amounts of powder were added to increase the braze wetting and the bond strength. Niobium and chromium are among the elements that bond more readily with diamond materials. In reference to Examples 4, 7, 9-12, 12, 22 and 23, each of which use a strip of braze, the last component (e.g., "5Ti") comprises the amount and kind of coating applied to the strip. What this means is that the actual braze joint has a composition slightly different from the composition of the strip itself. For example, in Example 4, the actual braze joint has a composition equal to 72/105 weight percent Ag, 28/105 Cu and 5/105 Ti. For Examples 15, 16 and 20, each of which is a paste alloy, the last component (e.g., "0.5Ti") comprises the amount and kind of material added to the braze alloy. What this means is that the actual braze joint has a composition slightly different from the initial composition of the paste itself. For example, in Example 20, the actual braze joint has a composition equal to 72/100.5 weight percent Ag, 28/100.5 Cu and 0.5/100.5 Ti.

In regard to the ROC compaction processing, all of the Examples 1-28 were compacted via a ROC process at a pressure of 120,000 psi for a duration equal to about one minute and at the temperatures set forth in Table 1 as the ROC temperature (° C.), which are roughly at about 50° C. above the liquidus of the braze alloy. For each one of Examples 1-28, Table 1 also sets forth the kind of pressure transmitting material.

For each one of Examples 1-28, Table 1 also sets forth the nature of the TSP diamond material. In this regard, the term "leached" means that the TSP diamond was fully leached in that all of the cobalt was fully leached out of the diamond. The following patent documents, which have been listed hereinabove, disclose typical TSP material that has been subjected to cobalt leaching at least to some extent: U.S. Pat. No. 4,931,363 to Slutz et al., U.S. Pat. No. 6,592,985 to Griffin et al., and U.S. Pat. No. 5,127,923 to Bunting et al.

As used in Table 1, the term "SiC bond" means that the TSP diamond material was made by mixing together the diamond component and the silicon carbide component and then consolidating the mixture to form SiC-bonded TSP diamond member. U.S. Patent Application Publication No. US 2006/0207802 to Zhang et al, mentions this kind of TSP at Paragraph [0037] thereof. As used in Table 1, the term "Si-compound" means that the TSP diamond material (45 micron grain size of the diamond) was made by mixing together the diamond component and the silicon-compound component and then consolidating the mixture to form the Si-compound TSP diamond member.

The term "leached/Ni coated" means that the TSP diamond member (5 micron grain size of the diamond) was fully leached of all cobalt. The fully cobalt-leached diamond member was then coated with nickel. The following patent documents, which have been listed hereinabove, disclose cobalt-leached diamond members that have been nickel coated: United States Application Publication No. US 2006/0254830 to Radtke and U.S. Pat. No. 6,575,350 B2 to Evans et al.

TABLE 1

Composition (and Supplier and Designation) of the Braze Alloy, Nature of the TSP Diamond, Selected ROC Parameters and Glass Media for Examples 1 through 28

| Example | Braze Alloy Composition and (Liquidus° C.) | Company and designated name for the braze alloys | Nature of the TSP Diamond | ROC Temp (° C.) | ROC Media |
|---|---|---|---|---|---|
| 1 | 56Ag—42Cu—2Ni Strip (893° C.) | Prince & Izant, SB56NI2 | Leached | 920 | pyrex ® |
| 2 | 56Ag—42Cu—2Ni Strip (893° C.) | Prince & Izant, SB56NI2 | Leached | 920 | sodalime |
| 3 | 87Cu—7P—6Ag Paste (718° C.) | Fusion, LHK-1306-650 | Leached | 800 | pyrex ® |

TABLE 1-continued

Composition (and Supplier and Designation) of the Braze Alloy, Nature of the TSP Diamond, Selected ROC Parameters and Glass Media for Examples 1 through 28

| Example | Braze Alloy Composition and (Liquidus° C.) | Company and designated name for the braze alloys | Nature of the TSP Diamond | ROC Temp (° C.) | ROC Media |
|---|---|---|---|---|---|
| 4 | 72Ag—28Cu—5Ti Strip (780° C.) | Lucas-Milhaupt, Cerametil 721 | Leached | 800 | pyrex ® |
| 5 | 56Ag—42Cu—2Ni Strip (893° C.) | Prince & Izant, SB56NI2 | SiC Bond | 920 | pyrex ® |
| 6 | 56Ag—42Cu—2Ni Strip (893° C.) | Prince & Izant, SB56NI2 | SiC Bond | 920 | sodalime |
| 7 | 72 Ag—28Cu—5Ti Strip (780° C.) | Lucas-Milhaupt, Cerametil 721 | SiC Bond | 800 | pyrex ® |
| 8 | 87Cu—7P—6Ag Paste (718° C.) | Fusion, LHK-1306-650 | SiC Bond | 800 | pyrex ® |
| 9 | 71.5Ag—28.0Cu—0.5Ni—5Ti Strip (795° C.) | Lucas-Milhaupt, Cerametil 716 | Si-Compound | 850 | pyrex ® |
| 10 | 71.5Ag—28.0Cu—0.5Ni—5Ti Strip (795° C.) | Lucas-Milhaupt, Cerametil 716 | Si-Compound | 850 | Sodalime |
| 11 | 72Ag—28Cu—5Ti Strip (780° C.) | Lucas-Milhaupt, Cerametil 721 | Si-Compound | 830 | pyrex ® |
| 12 | 72Ag—28Cu—5Ti Strip (780° C.) | Lucas-Milhaupt, Cerametil 721 | Si-Compound | 830 | sodalime |
| 13 | 80Cu—15Ag—5P Strip (804° C.) | Prince & Izant, SP15 | Si-Compound | 850 | pyrex ® |
| 14 | 80Cu—15Ag—5P Strip (804° C.) | Prince & Izant, SP15 | Si-Compound | 850 | sodalime |
| 15 | 72Ag—28Cu—0.5Ti Paste (780° C.) | Lucas-Milhaupt alloy: 40-074 BLA 074 | Si-Compound | 830 | pyrex ® |
| 16 | 72Ag—28Cu—0.5Ti Paste (780° C.) | Lucas-Milbaupt alloy: 40-074 BLA 074 | Si-Compound | 830 | sodalime |
| 17 | 72Ag—28Cu—5Ti— Strip + Nb powder (780° C.) | Lucas-Milhaupt, Cerametil 721 | Leached/Nickel Coated | 830 | pyrex ® |
| 18 | 72Ag—28Cu—5Ti— Strip + Nb powder (780° C.) | Lucas Milbaupt, Cerametil 721 | Leached/Nickel Coated | 830 | sodalime |
| 19 | 72Ag—28Cu—5Ti— Strip + Cr powder 780° C.) | Lucas Milhaupt, Cerametil 721 | Leached/Nickel Coated | 830 | pyrex ® |
| 20 | 72Ag—28Cu—0.5Ti Paste (780° C.) | Lucas-Milhaupt alloy: 40-074 BLA 074 | Leached/Nickel Coated | 830 | sodalime |
| 21 | 71.5Ag—28.0Cu—0.5Ni—5Ti Strip (795° C.) | Lucas-Milhaupt, Cerametil 716 | Leached/Nickel Coated | 850 | pyrex ® |
| 22 | 71.5Ag—28.0Cu—0.5Ni—5Ti Strip (795° C.) | Lucas-Milhaupt, Cerametil 716 | Leached/Not Coated | 850 | sodalime |
| 23 | 72Ag—28Cu—5Ti Strip (780° C.) | Lucas Milhaupt, Cerametil 721 | Leached/Not Coated | 830 | Sodalime |
| 24 | 92.75Cu—3Si—2Al—2.25Ti Strip (1024° C.) | Morgan advanced ceramics/Wesgo CU-ABA | Leached/Not Coated | 1070 | pyrex ® |
| 25 | 56.55Ni—30.5Pd—10.5Cr—2.45B Strip (977° C.) | Morgan advanced ceramics/Wesgo Palnicro-30 | Leached/Not Coated | 1030 | pyrex-® |
| 26 | 56Ag—42Cu—2Ni Strip (893° C.) | Prince & Izant, SB56NI2 | Leached/Not Coated | 940 | sodalime |
| 27 | 72Ag—28Cu—5Ti Strip (780° C.) | Lucas Milhaupt, Cerametil 721 | Leached/Not Coated | 830 | sodalime |
| 28 | 56.55Ni—30.5Pd—10.5Cr—2.45B Strip (977° C.) | Morgan advanced ceramics/Wesgo Palnicro-30 | Leached/Not Coated | 1030 | pyrex ® |

For certain ones of the examples, the microstructure of the interface between the TSP diamond member and the braze alloy, as well as the interface between the braze alloy and the cemented (cobalt) tungsten carbide substrate, was evaluated through photomicrographs. A discussion of these photomicrographs is set forth hereinafter. The typical structure of the hard compact test specimen is shown in FIG. 11, which is Example 17.

Figure 11:
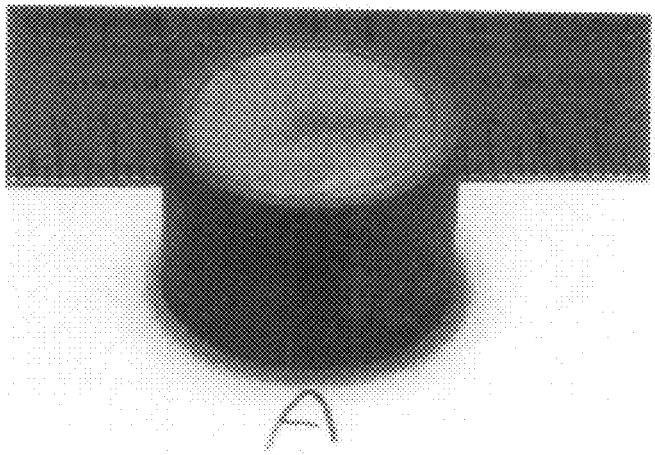
FIG. 11 is a photograph of the hard compact of Example 17 as set forth in Table 1 hereof with the carbide cap, which is present during the ROC process, removed.
Figure 20:
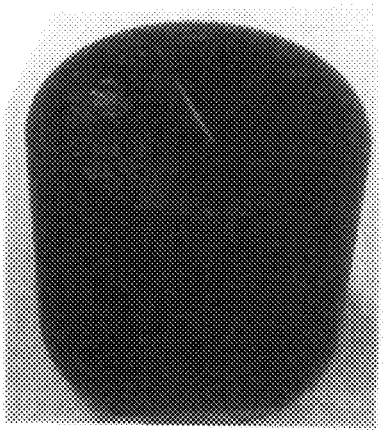
FIG. 20 is a photograph of the graphite cup that contains the components of the hard compact with a carbide cap positioned on the components.

FIG. 11 shows the hard compact after completion of the ROC process wherein the carbide cap used during the ROC process is absent. In the typical ROC process used to make the hard compacts, a carbide cap or a graphite cap may be placed on top of the components so as to minimize any penetration into the hard compact by the glass ROC media (see FIG. 20). Applicants have found that a carbide cap tends to adhere to the hard compact after completion of the ROC process. This is in distinction from a graphite cap that does not tend to adhere to the hard compact after completion of the ROC process.

Figure 21:
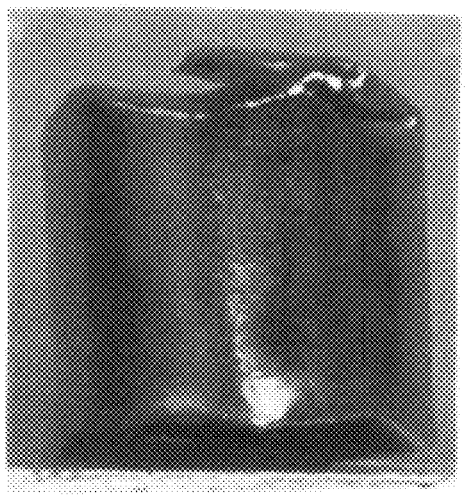
FIG. 21 is a photograph of the graphite cup-carbide cap assembly, which has the components of the hard compact contained therein, wrapped with grafoil (i.e., graphite foil) wherein the graphite foil helps protect the hard compact from glass penetration during the ROC process.

Further, the assembly of the components with the carbide cap or graphite cap attached thereto is wrapped in graphite foil or grafoil (see FIG. 21). Wrapping the components in graphite foil helps prevent the penetration of glass into the hard compact during the ROC process. To obtain the photomicrographs, a portion of the side of the hard compact was removed via grinding and the surface treated according to accepted practice to prepare the surface so that the microstructure would be visible and photomicrographs taken.

Figure 11A:
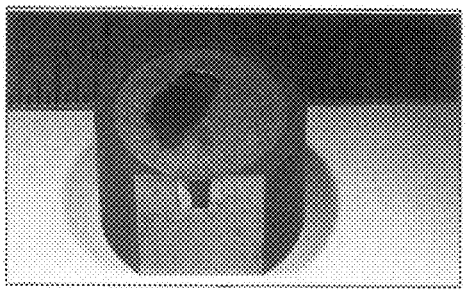
FIG. 11A is a photograph of the hard compact of Example 20 as set forth in Table 1 wherein a portion of the cylindrical side wall has been ground to expose the superhard member-braze joint and the cemented (cobalt) tungsten carbide-braze joint.
Figure 11B:
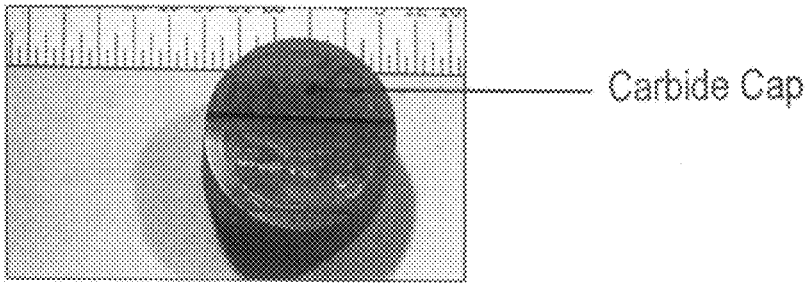
FIG. 11B is a photograph of the hard compact of Example 1 as set forth in Table 1 wherein a portion of the carbide cap (see reference to "carbide cap" in the photograph) has been ground to expose the superhard member-braze joint and the cemented (cobalt) tungsten carbide-braze joint.
Figure 11C:
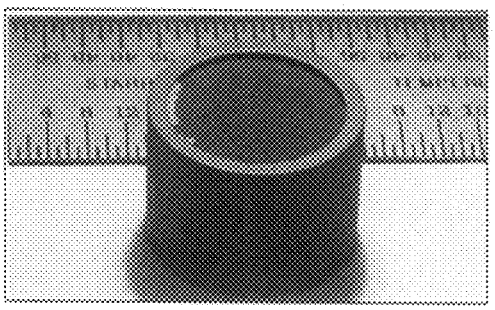
FIG. 11C is a photograph of the hard compact of Example 16 as set forth in Table 1 wherein the carbide cap has been removed since it sometimes does not adhere to the hard compact after completion of the ROC process.

FIGS. 11A through 11E illustrate the hard compact of different samples in differing conditions. In this regard, FIG. 11A is a photograph of the hard compact of Example 20 as set forth in Table 1 wherein a portion of the cylindrical side wall has been ground to expose the superhard member-braze joint and the cemented (cobalt) tungsten carbide-braze joint. FIG. 11B is a photograph of the hard compact of Example 1 as set forth in Table 1 wherein a portion of the carbide cap (see reference to "carbide cap" in the photograph) has been ground to expose the superhard member-braze joint and the cemented (cobalt) tungsten carbide-braze joint. FIG. 11C is a photograph of the hard compact of Example 16 as set forth in Table 1 wherein the carbide cap is absent. These examples use a carbide cap which typically adheres to the hard compact.

Figure 11D:
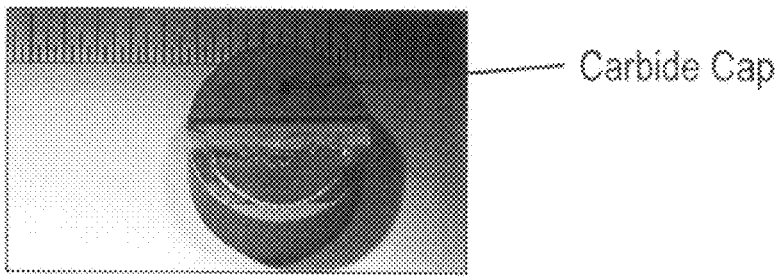
FIG. 11D is a photograph of the hard compact of Example 4 as set forth in Table 1 wherein a portion of the carbide cap (see reference to "carbide cap" in the photograph) has been ground to expose the superhard member-braze joint and the cemented (cobalt) tungsten carbide-braze joint.
Figure 11E:
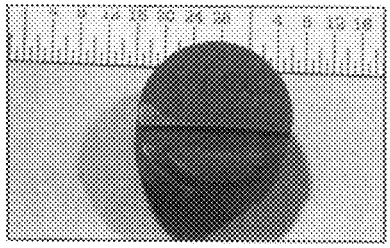
FIG. 11E is a photograph of the hard compact of Example 2 as set forth in Table 1 wherein a portion of the carbide cap has been ground to expose the superhard member-braze joint and the cemented (cobalt) tungsten carbide-braze joint.

FIG. 11D is a photograph of the hard compact of Example 4 as set forth in Table 1 wherein a portion of the carbide cap (see reference to "carbide cap" in the photograph) has been ground to expose the superhard member-braze joint and the cemented (cobalt) tungsten carbide-braze joint. FIG. 11E is a photograph of the hard compact of Example 2 as set forth in Table 1 wherein a portion of the carbide cap has been ground to expose the superhard member-braze joint and the cemented (cobalt) tungsten carbide-braze joint.

Figure 12:
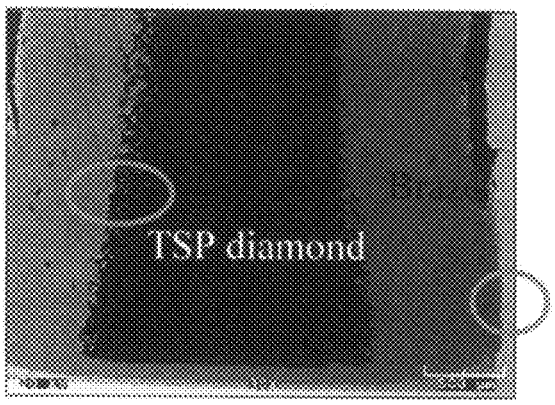
FIG. 12 is a photomicrograph taken via scanning electron microscopy at a magnification of 30× (and a scale of 500 microns) of Example 21 of the interface between the TSP diamond member and the braze alloy and the braze alloy and the cemented (cobalt) tungsten carbide substrate, and where this photomicrograph includes two ovals wherein the left-hand oval designates a region at the interface between the TSP diamond and the braze layer and the right-hand oval designates a region at the interface between the braze layer and the cemented (cobalt) tungsten carbide.
Figure 12A:
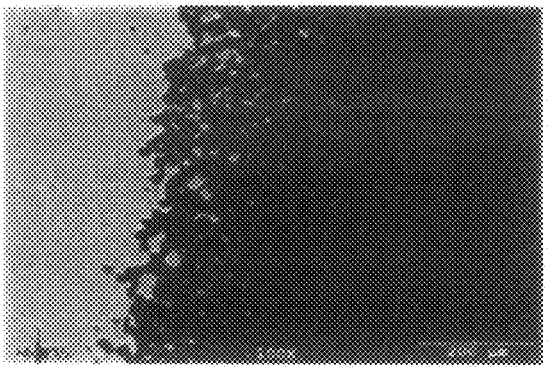
FIG. 12A is a photomicrograph taken via scanning electron microscopy at a magnification of 100× (and a scale of 200 micrometers) of Example 21 of the interface in the region of the left-hand oval of FIG. 12 between the TSP diamond member and the braze alloy as shown in the region.

FIG. 12 is a photomicrograph taken via scanning electron microscopy at a magnification of 30× (and a scale of 500 microns) of Example 21 of the interface between the TSP diamond member and the braze alloy and the braze alloy and the cemented (cobalt) tungsten carbide substrate. This photomicrograph shows the metallurgical bonds between the braze material and both the cemented (cobalt) tungsten carbide substrate and the TSP diamond member. The braze material has been forced or extruded into the porosity (or voids) of the TSP diamond member. FIG. 12 includes two ovals wherein the left-hand oval designates a region at the interface between the TSP diamond and the braze layer and the right-hand oval designates a region at the interface between the braze layer and the cemented (cobalt) tungsten carbide. More detailed photomicrographs of this Example 21 are set forth in FIG. 12A through FIG. 12D.

Figure 12B:
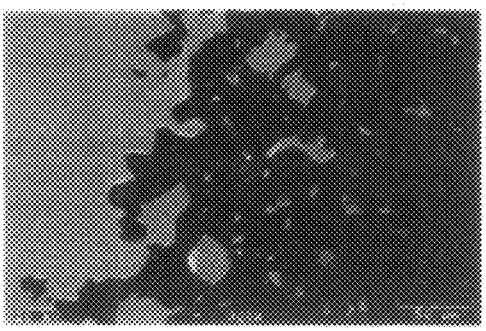
FIG. 12B is a photomicrograph taken via scanning electron microscopy at a magnification of 3100× (and a scale of 50 micrometers) of Example 21 of the interface in the region of the left-hand oval of FIG. 12 between the TSP diamond member and the braze alloy as shown in the region.

In reference to FIGS. 12A through 12D, FIG. 12A is a photomicrograph taken via scanning electron microscopy at a magnification of 100× (and a scale of 200 micrometers) of Example 21 and FIG. 12B is a photomicrograph taken via scanning electron microscopy at a magnification of 3100× (and a scale of 50 micrometers) of Example 21 wherein both photomicrographs are of the interface in the region of the left hand oval of FIG. 12 between the TSP diamond member and the braze alloy. A review of the photomicrographs shows that the braze material has extruded into the porosity (or voids) in the TSP diamond member. The photomicrographs also show a metallurgical bond between the TSP and the braze.

Figure 12C:
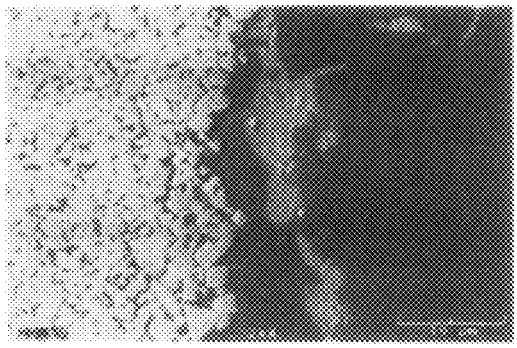
FIG. 12C is a photomicrograph taken via scanning electron microscopy at a magnification of 2000× (and a scale of 10 micrometers) of Example 21 of the interface in the region of the right-hand oval of FIG. 12 between the braze alloy and the cemented (cobalt) tungsten carbide substrate as shown in the region.
Figure 12D:
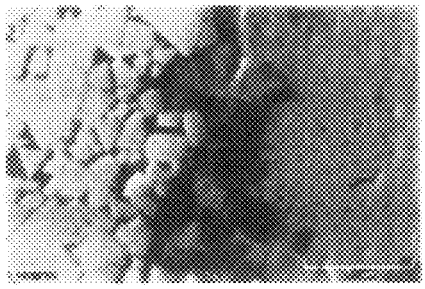
FIG. 12D is a photomicrograph taken via scanning electron microscopy at a magnification of 5000× (and a scale of 5 micrometers) of Example 21 of the interface in the region of the right-hand oval of FIG. 12 between the braze alloy and the cemented (cobalt) tungsten carbide substrate as shown in the region.

FIG. 12C is a photomicrograph taken via scanning electron microscopy at a magnification of 2000× (and a scale of 10 micrometers) of Example 21 and FIG. 12D is a photomicrograph taken via scanning electron microscopy at a magnification of 5000× (and a scale of 5 micrometers) of Example 21 wherein both photomicrographs are of the interface in the region of the right hand oval of FIG. 12 between the braze alloy and the cemented (cobalt) tungsten carbide substrate. FIGS. 12C and 12D show that the bonding between the braze and the cemented (cobalt) tungsten carbide substrate is due to a metallurgical surface wetting phenomenon or metallurgical bond.

Overall, an examination of the microstructure as shown in FIGS. 12 through 12D shows a metallurgical bond between the braze and the TSP diamond member and between the braze and the cemented (cobalt) tungsten carbide substrate. In the case of the braze-TSP bond, the metallurgical bond is improved by the extrusion of the braze material into the porosity of the TSP diamond member.

Figure 13:
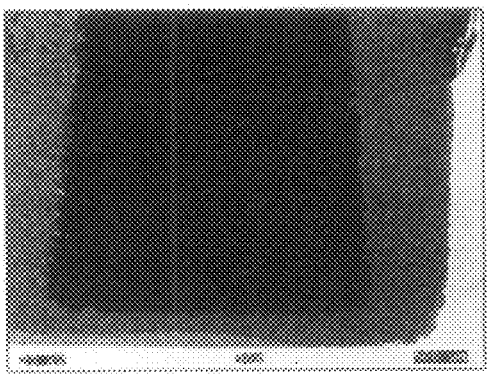
FIG. 13 is a photomicrograph taken via scanning electron microscopy at a magnification of 30× (and a scale of 500 micrometers) of Example 18 of the interface between the TSP diamond member and the braze alloy and the cemented (cobalt) tungsten carbide substrate.

FIG. 13 is a photomicrograph taken via scanning electron microscopy at a magnification of 30× (and a scale of 500 micrometers) of Example 18 of the interface between the TSP diamond member and the braze alloy and the cemented (cobalt) tungsten carbide substrate. An examination of the microstructure shown in this photomicrograph reveals the metallurgical bond between the braze material and both the cemented (cobalt) tungsten carbide substrate and the TSP diamond member. The braze material has been forced into the TSP diamond member.

Figure 14:
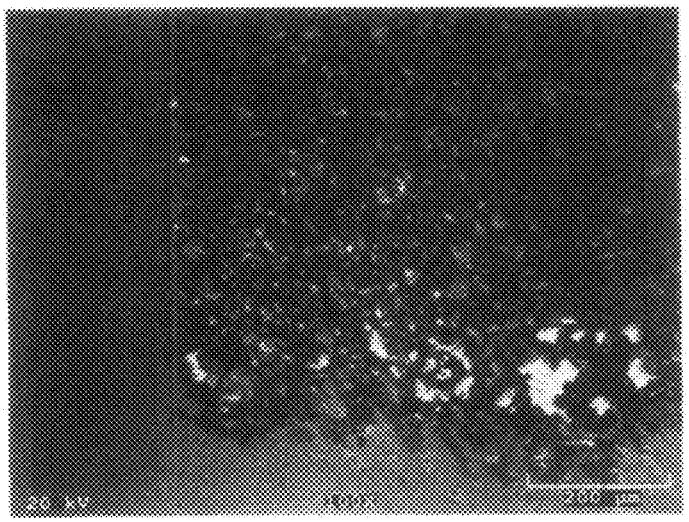
FIG. 14 is a photomicrograph taken via scanning electron microscopy at a magnification of 100× (and a scale of 200 micrometers) of Example 1 of the interface between the TSP diamond member and the braze alloy and the cemented (cobalt) tungsten carbide substrate.

FIG. 14 is a photomicrograph taken via scanning electron microscopy at a magnification of 100× (and a scale of 200 micrometers) of Example 1 of the interface between the TSP diamond member and the braze alloy and the cemented (cobalt) tungsten carbide substrate. An examination of the microstructure shown in this photomicrograph reveals that a uniform amount of braze bonded to both the TSP diamond member and the cemented (cobalt) tungsten carbide substrate.

Figure 15:
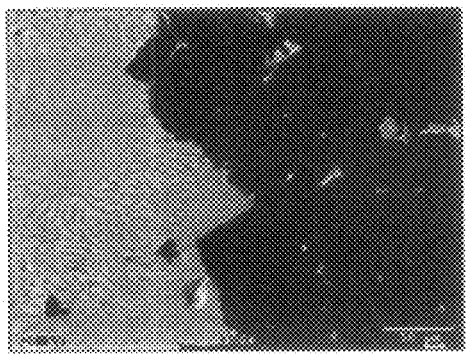
FIG. 15 is a photomicrograph taken via scanning electron microscopy at a magnification of 300× (and a scale of 50 micrometers) of Example 15 of the interface between the TSP diamond member and the braze alloy.

FIG. 15 is a photomicrograph taken via scanning electron microscopy at a magnification of 300× (and a scale of 50 micrometers) of Example 15 of the interface between the TSP diamond member and the braze alloy. An examination of the microstructure shown in this photomicrograph reveals that the braze material has been forced or extruded into the TSP diamond member during the ROC process.

Figure 16:
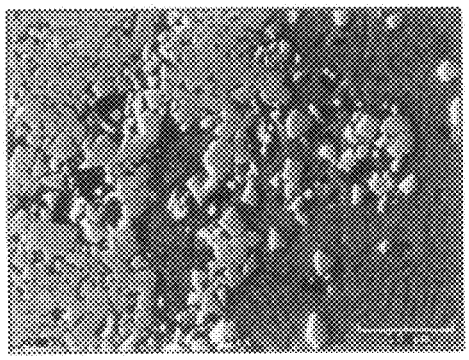
FIG. 16 is a photomicrograph taken via scanning electron microscopy at a magnification of 2000× (and a scale of 10 micrometers) of Example 25 of the interface between the cemented (cobalt) tungsten carbide substrate and the braze alloy.

FIG. 16 is a photomicrograph taken via scanning electron microscopy at a magnification of 2000× (and a scale of 10 micrometers) of Example 25 of the interface between the cemented (cobalt) tungsten carbide substrate and the braze alloy. An examination of the microstructure shown in this photomicrograph reveals that the braze material can have a metallurgical bond with the cemented (cobalt) tungsten carbide substrate.

Figure 17:
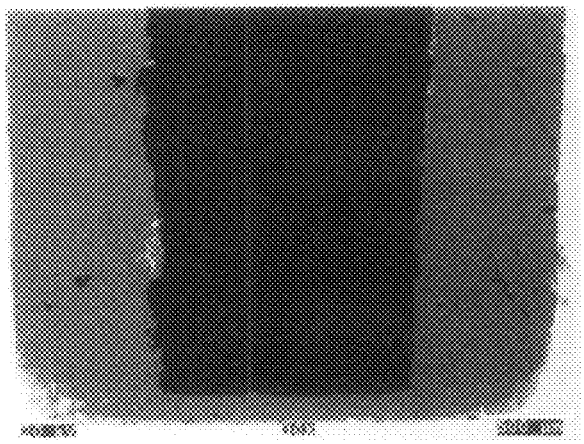
FIG. 17 is a photomicrograph taken via scanning electron microscopy at a magnification of 30× (and a scale of 500 micrometers) of Example 20 of the interface between the TSP diamond member and the braze alloy and the cemented (cobalt) tungsten carbide substrate.

FIG. 17 is a photomicrograph taken via scanning electron microscopy at a magnification of 30× (and a scale of 500 micrometers) of Example 20 of the interface between the TSP diamond member and the braze alloy and the cemented (cobalt) tungsten carbide substrate. An examination of the microstructure shown in this photomicrograph reveals the metallurgical bonds between the braze material and both the cemented (cobalt) tungsten carbide substrate and the TSP diamond member. The braze material has been forced or extruded into the TSP diamond member.

Figure 18:
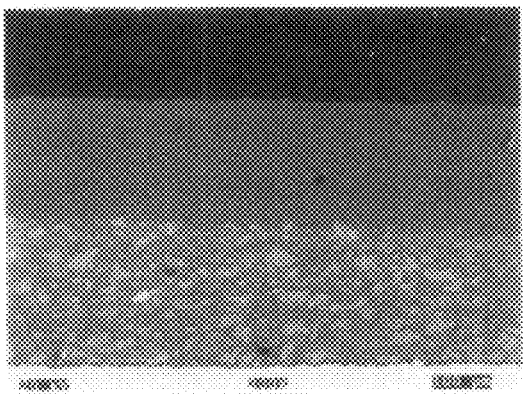
FIG. 18 is a photomicrograph taken via scanning electron microscopy at a magnification of 200× (and a scale of 100 micrometers) of Example 17 of the interface between the TSP diamond member and the braze alloy and the cemented (cobalt) tungsten carbide substrate.

FIG. 18 is a photomicrograph taken via scanning electron microscopy at a magnification of 200× (and a scale of 100 micrometers) of Example 17 of the interface between the TSP diamond member and the braze alloy and the cemented (cobalt) tungsten carbide substrate. An examination of the microstructure shown in this photomicrograph reveals the metallurgical bonds between the braze material and both the cemented (cobalt) tungsten carbide substrate and the TSP diamond member.

Figure 19:
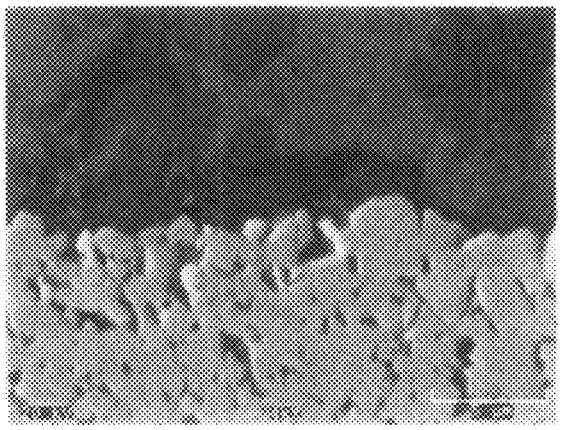
FIG. 19 is a photomicrograph taken via scanning electron microscopy at a magnification of 4000× (and a scale of 5 micrometers) of Example 18 of the interface between the braze alloy and the cemented (cobalt) tungsten carbide substrate.

FIG. 19 is a photomicrograph taken via scanning electron microscopy at a magnification of 4000× (and a scale of 5 micrometers) of Example 18 of the interface between the braze alloy and the cemented (cobalt) tungsten carbide substrate. An examination of the microstructure shown in this photomicrograph reveals the metallurgical bonds between the braze material and both the cemented (cobalt) tungsten carbide substrate.

Overall, the photomicrographs show that the ROC process is a novel and successful process to bond thermally stable polycrystalline diamonds to a cemented (cobalt) carbide substrate.

It can be appreciated that the present invention provides an improved hard compact, which comprises a hard metal substrate bonded to a superhard (e.g., polycrystalline diamond) member wherein such hard compact can be used in tools such as earth boring or engaging bits through an improved ability to facilitate the attachment of the hard compact to the tool. Further, it can be appreciated that the present invention provides the ability to bond together a superhard member and a substrate that have heretofore been difficult to satisfactorily bond together to form a hard compact so as to result in an improved ability to facilitate the attachment of the hard compact to the tool.

Also, it can be appreciated that the invention provides a hard compact (or even a new generation of PCD cutters) where thermally stable polycrystalline diamond is successfully bonded to a substrate (e.g., a cemented (cobalt) tungsten carbide substrate) wherein the hard compact exhibits increased (or better) drilling footage and longer drilling life without graphitization of the diamond at a temperature up to about 1200° C. Heretofore, earlier PCD (polycrystalline diamond) hard compacts have experienced degradation (e.g., graphitization) problems at temperatures equal to about 700-800° C., and most certainly such hard compacts have experienced such problems at temperatures equal to or greater than about 1200° C.

All patents, patent applications, articles and other documents identified herein are hereby incorporated by reference herein. Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed:

1. A rapid omni-directional compaction process for producing a hard composite body comprising the steps of:

providing a pre-compaction composite comprising a substrate comprising a partially dense green body containing a cavity opening at one surface of the green body, and the pre-compaction composite further comprising a superhard member within the cavity, and wherein the superhard member comprises one selected from the group consisting of cobalt-leached TSP diamond or silicon carbide-bonded TSP diamond or silicon compound-bonded TSP diamond or nickel-coated cobalt-leached TSP diamond or coated cobalt-leached TSP diamond;

placing the pre-compaction composite in a bed of flowable particles; and effecting pressurization of said bed to cause pressure transmission equal to or greater than about 60,000 psi via said particles to said pre-compaction composite, thereby to consolidate the pre-compaction composite into the hard composite body wherein the hard composite body comprises the superhard member mechanically retained within the cavity due to the shrinkage in volume of the partially dense green body upon consolidation of the pre-compaction composite.

2. The process of claim 1 wherein the substrate comprises a metal binder and a hard carbide wherein the binder is selected from the group comprising cobalt, iron, nickel and their alloys, and the carbide is selected from the group comprising the Group IVA and VA metal carbides and solid solutions thereof.

3. The process of claim 1 wherein the coating for the cobalt-leached TSP diamond comprises one or more of nickel metal or titanium metal or tungsten metal or titanium carbide applied via physical vapor deposition (PVD) techniques.

4. A rapid omni-directional compaction process for producing a dense, consolidated hard compact adapted to be affixed to a drill bit body, the process comprising the steps of:

providing a pre-compaction composite comprising a substrate, a superhard member and a layer of braze between the substrate and the superhard member wherein the superhard member comprises one selected from the group consisting of cobalt-leached TSP diamond or silicon carbide-bonded TSP diamond or silicon compound-bonded TSP diamond or nickel-coated cobalt-leached TSP diamond or coated cobalt-leached TSP diamond;

placing the pre-compaction composite in a pressure transmitting material contained within a shell to form an isostatic die assembly;

heating the isostatic die assembly to a temperature at which the pressure-transmitting material is capable of fluidic flow and wherein the temperature ranges between greater than the melting point of the braze layer and less than or equal to about 1200° C.;

in a forging press, compressing the isostatic die assembly to consolidate the pre-compaction composite under omnidirectional pressure equal to or greater than about 60,000 psi into a dense, consolidated hard compact wherein the dense, consolidated hard compact comprises the substrate and a distinct layer on the substrate wherein the distinct layer comprises the superhard member having braze extruded therein; and wherein the superhard member comprises one of the cobalt-leached TSP diamond, the nickel-coated cobalt-leached TSP diamond and the coated cobalt-leached TSP diamond.

5. The process of claim 4 wherein the cobalt-leached TSP diamond is partially leached of cobalt.

6. The process of claim 4 wherein the cobalt-leached TSP diamond is fully leached of cobalt.

7. The process of claim 1 wherein the superhard member comprises one of the cobalt-leached TSP diamond, the nickel-coated cobalt-leached TSP diamond and the coated cobalt-leached TSP diamond.

8. The process of claim 7 wherein the cobalt-leached TSP diamond is partially leached of cobalt.

9. The process of claim 7 wherein the cobalt-leached TSP diamond is fully leached of cobalt.

10. A rapid omni-directional compaction process for producing a hard composite body comprising the steps of:

providing a pre-compaction composite comprising a substrate comprising a partially dense green body containing a cavity opening at one surface of the green body; the pre-compaction composite further comprising a superhard member within the cavity, and the superhard member comprises one selected from the group consisting of cobalt-leached TSP diamond or silicon carbide-bonded TSP diamond or silicon compound-bonded TSP diamond or nickel-coated cobalt-leached TSP diamond or coated cobalt-leached TSP diamond; the pre-compaction composite further comprising a braze between the superhard member and the partially dense green body defining the cavity;

placing the pre-compaction composite in a bed of flowable particles; and effecting pressurization of said bed to cause pressure transmission equal to or greater than about 60,000 psi via said particles to said pre-compaction composite, thereby to consolidate the pre-compaction composite into the hard composite body wherein the hard composite body comprises the superhard member mechanically retained within the cavity due to the shrinkage in volume of the partially dense green body upon consolidation of the pre-compaction composite and the superhard member metallurgically bonded to the consolidated green body due to the braze extruded into the superhard member.

* * * * *